US011479836B2

(12) United States Patent
Muralidharan et al.

(10) Patent No.: US 11,479,836 B2
(45) Date of Patent: Oct. 25, 2022

(54) LOW-COST, HIGH-STRENGTH, CAST CREEP-RESISTANT ALUMINA-FORMING ALLOYS FOR HEAT-EXCHANGERS, SUPERCRITICAL $CO_2$ SYSTEMS AND INDUSTRIAL APPLICATIONS

(71) Applicant: UT-BATTELLE, LLC, Oak Ridge, TN (US)

(72) Inventors: Govindarajan Muralidharan, Knoxville, TN (US); Michael P. Brady, Oak Ridge, TN (US); Yukinori Yamamoto, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 129 days.

(21) Appl. No.: 17/162,890

(22) Filed: Jan. 29, 2021

(65) Prior Publication Data

US 2022/0243304 A1 Aug. 4, 2022

(51) Int. Cl.
*C22C 19/05* (2006.01)

(52) U.S. Cl.
CPC ..... *C22C 19/056* (2013.01)

(58) Field of Classification Search
CPC ..... C22C 19/056; C22C 19/055; C22F 1/10
See application file for complete search history.

(56) References Cited

U.S. PATENT DOCUMENTS

| | | | |
|---|---|---|---|
| 3,754,898 | A | 8/1973 | McGurty |
| 3,826,689 | A | 7/1974 | Ohta et al. |
| 3,839,022 | A | 10/1974 | Webster et al. |
| 3,865,581 | A | 2/1975 | Sekino et al. |
| 3,865,644 | A | 2/1975 | Hellner et al. |
| 3,989,514 | A | 11/1976 | Fujioka et al. |
| 4,086,085 | A | 4/1978 | McGurty |
| 4,204,862 | A | 5/1980 | Kado et al. |
| 4,359,350 | A | 11/1982 | Laidler et al. |
| 4,385,934 | A | 5/1983 | McGurty |
| 4,530,720 | A | 7/1985 | Moroishi et al. |
| 4,560,408 | A | 12/1985 | Wilhelmsson |
| 4,572,738 | A | 2/1986 | Korenko et al. |
| 4,576,653 | A | 3/1986 | Ray |
| 4,767,597 | A | 8/1988 | Nishino et al. |
| 4,818,485 | A | 4/1989 | Maziasz et al. |
| 4,822,695 | A | 4/1989 | Larson et al. |
| 4,849,169 | A | 7/1989 | Maziasz et al. |
| 5,130,085 | A | 7/1992 | Tendo et al. |
| 5,217,684 | A | 6/1993 | Igarashi et al. |
| 5,480,283 | A | 1/1996 | Doi et al. |
| 5,501,834 | A | 3/1996 | Nakasuji et al. |
| 5,556,594 | A | 9/1996 | Frank et al. |
| 5,603,891 | A | 2/1997 | Brill |
| 5,618,491 | A | 4/1997 | Kurup et al. |
| 5,945,067 | A | 8/1999 | Hibner et al. |
| 6,004,408 | A | 12/1999 | Montagnon |
| 6,193,145 | B1 | 2/2001 | Fournier et al. |
| 6,352,670 | B1 | 3/2002 | Rakowski |
| 6,372,181 | B1 | 4/2002 | Fahrmann et al. |
| 6,447,716 | B1 | 9/2002 | Cozar et al. |
| 6,866,816 | B2 | 3/2005 | Liang et al. |
| 7,744,813 | B2 | 6/2010 | Brady et al. |
| 7,754,144 | B2 | 7/2010 | Brady et al. |
| 7,754,305 | B2 | 7/2010 | Yamamoto et al. |
| 8,431,072 | B2 * | 4/2013 | Muralidharan ..... C22C 38/54 420/47 |
| 8,815,146 | B2 | 8/2014 | Yamamoto et al. |
| 9,249,482 | B2 | 2/2016 | Jakobi et al. |
| 10,053,756 | B2 | 8/2018 | Jakobi et al. |
| 10,174,408 | B2 | 1/2019 | Muralidharan et al. |
| 10,207,242 | B2 | 2/2019 | Chun et al. |
| 2004/0060622 | A1 | 4/2004 | Lilley |
| 2004/0191109 | A1 | 9/2004 | Maziasz et al. |
| 2005/0129567 | A1 | 6/2005 | Kirchheiner et al. |
| 2007/0086910 | A1 | 4/2007 | Liang |
| 2007/0217941 | A1 | 9/2007 | Hayashi et al. |
| 2008/0292489 | A1 | 11/2008 | Yamamoto et al. |
| 2011/0250463 | A1 | 10/2011 | Helander et al. |
| 2012/0301347 | A1 | 11/2012 | Muralidharan et al. |
| 2013/0126056 | A1 | 5/2013 | Feng et al. |
| 2016/0167009 | A1 | 6/2016 | Chun et al. |
| 2016/0369376 | A1 | 12/2016 | Muralidharan et al. |
| 2019/0106770 | A1 | 4/2019 | Kirchheiner et al. |
| 2019/0169714 | A1 | 6/2019 | Muralidharan et al. |

(Continued)

OTHER PUBLICATIONS

Yamamoto, et al., "Alumina-Forming Austenitic Stainless Steels Strengthened by Laves Phase and MC Carbide Precipitates," Metallurgical and MaterialsTransactions A, 2007.

Brady, et al., Effects of Minor Alloy Additions and Oxidation Temperature on Protective Alumina Scale Formation in Creep-Resistant Austenitic Stainless Steels, Scripta Materialia, 2007, pp. 1117-1120, vol. 57.

Asterman et al.: "The Influence of Al Content on the High Temperature Oxidation Properties of State-of-the-Art Cast Ni-base Alloys", Oxid Met (2013) 80:3-12.

(Continued)

*Primary Examiner* — Jessee R Roe

(74) *Attorney, Agent, or Firm* — Fox Rothschild LLP

(57) ABSTRACT

An austenitic Ni-base alloy includes, in weight percent: 2.5 to 4.75 Al; 13 to 21 Cr; 20 to 40 Fe; 2 to 5 total of at least one element selected from the group consisting of Nb and Ta; 0.25 to 4.5 Ti; 0.09 to 1.5 Si; 0 to 0.5 V; 0 to 2 Mn; 0 to 3 Cu; 0 to 2 of Mo and W; 0 to 1 of Zr and Hf; 0 to 0.15 Y; 0.01 to 0.45 C; 0.005 to 0.1 B; 0 to 0.05 P; less than 0.06 N; and balance Ni (38 to 46 Ni). The weight percent Ni is greater than the weight percent Fe. An external continuous scale comprises alumina. A stable phase FCC austenitic matrix microstructure is essentially delta-ferrite-free, and contains one or more carbides and coherent precipitates of γ' and exhibits creep rupture life of at least 100 h at 900° C. and 50 MPa.

14 Claims, 40 Drawing Sheets

(56) References Cited

U.S. PATENT DOCUMENTS

| | | | |
|---|---|---|---|
| 2019/0226065 | A1 | 7/2019 | Maziasz et al. |
| 2019/0330723 | A1 | 10/2019 | Maziasz et al. |

OTHER PUBLICATIONS

International Search Report dated Apr. 12, 2022 in PCT/US22/14315.

International search report dated Apr. 12, 2022 in PCT/US22/14316.

* cited by examiner

LOW-COST, HIGH-STRENGTH, CAST CREEP-RESISTANT ALUMINA-FORMING ALLOYS FOR HEAT-EXCHANGERS, SUPERCRITICAL $CO_2$ SYSTEMS AND INDUSTRIAL APPLICATIONS

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates to cast alumina-forming alloys, and more particularly to high-strength, high temperature creep-resistant and corrosion-resistant alloys.

BACKGROUND OF THE INVENTION

Common austenitic stainless steels contain a maximum by weight percent of 0.15% carbon, a minimum of 16% chromium and sufficient nickel and/or manganese to retain a face centered-cubic (FCC) austenitic crystal structure at cryogenic temperatures through the melting point of the alloy. Austenitic stainless steels are non-magnetic non-heat-treatable steels that are usually annealed and cold worked. Common austenitic stainless steels are widely used in power generating applications; however, they are becoming increasingly less desirable as the industry moves toward higher thermal efficiencies. Higher operating temperatures in power generation result in reduced emissions and increased efficiencies. Conventional austenitic stainless steels currently offer good creep strength and environmental resistance up to 600-700° C. However, in order to meet emission and efficiency goals of the next generation of power plants structural alloys will be needed to increase operating temperatures by 50-100° C.

Austenitic stainless steels for high temperature use rely on $Cr_2O_3$ scales for oxidation protection. These scales grow relatively quickly. Conventional high-temperature stainless steels rely on chromium-oxide (chromia, $Cr_2O_3$) surface layers for protection from high-temperature oxidation. However, compromised oxidation resistance of chromia in the presence of aggressive species such as water vapor, carbon, sulfur, and the like typically encountered in energy production and process environments necessitates a reduction in operating temperature to achieve component durability targets. This temperature reduction reduces process efficiency and increases environmental emissions.

High nickel austenitic stainless steels and nickel based superalloys can meet the required property targets, but their costs for construction of power plants are prohibitive due to the high cost of nickel. Creep failure of common austenitic stainless steels such as types 316, 321, and 347 has limited the use of these.

A new class of austenitic stainless steels has been recently developed to be more oxidation resistant at higher temperature—these are the alumina-forming austenitic (AFA) stainless steels. These alloys are described in Yamamoto et al. U.S. Pat. No. 7,754,305, Brady et al U.S. Pat. No. 7,744,813, and Brady et al U.S. Pat. No. 7,754,144, Muralidharan U.S. Pat. No. 8,431,072, and Yamamoto U.S. Pat. No. 8,815,146, the disclosures of which are hereby incorporated fully by reference.

Alumina-forming austenitic (AFA) stainless steels are a new class of high-temperature (600-900° C.; 1112-1652° F.) structural alloy steels with a wide range of energy production, chemical/petrochemical, and process industry applications. These steels combine the relatively low cost, excellent formability, weldability, and good high-temperature creep strength (resistance to sagging over time) of state-of-the-art advanced austenitic stainless steels with fundamentally superior high-temperature oxidation (corrosion) resistance due to their ability to form protective aluminum oxide (alumina, $Al_2O_3$) surface layers.

Alumina grows at a rate 1 to 2 orders of magnitude lower than chromia and is also significantly more thermodynamically stable in oxygen, which results in its fundamentally superior high-temperature oxidation resistance. A further, key advantage of alumina over chromia is its greater stability in the presence of water vapor. Water vapor is encountered in most high-temperature industrial environments, ranging, for example, from gas turbines, combustion, and fossil-fired steam plants to solid oxide fuel cells. With both oxygen and water vapor present, volatile chromium oxy-hydroxide species can form and significantly reduce oxidation lifetime, necessitating significantly lower operating temperatures. This results in reduced process efficiency and increased emissions.

Many applications require complicated component shapes best achieved by casting (engine and turbine components). Casting can also result in lower cost tube production methods for chemical/petrochemical and power generation applications.

There is interest in the development of low-cost, high-strength, creep-resistant, oxidation resistant alloys for a variety of industrial and energy system applications in the 750° C.-900° C. temperature range. Traditionally high-strength, creep resistant alloys are Ni-based and contain 60-70 wt. % Ni+Co contents thus resulting in relatively high cost. For example, alloys such as Haynes®282® and IN 740®H are being considered for use in Advanced Ultra-supercritical steam and Supercritical $CO_2$ applications, particularly for use in the 750° C.-800° C. These are typically considered "wrought" alloys. Table 1 shows typical compositions of these alloys. It can also be seen from this table that these alloys are relatively high in Cr and are designed to obtain their oxidation resistance through the formation of chromia-scales. These alloys also contain Al and Ti and obtain their strength primarily through the formation of coherent, intermetallic γ' precipitates of the type $Ni_3$ (Al, X) where X can be Nb, Ti and other elements. The primary drawback of these alloys is that they are expensive due to the relatively high levels of Ni+Co and as explained later have inferior oxidation resistance compared to alumina-forming alloys.

TABLE 1

| State-of-the-art High-Strength, Creep-Resistant Being Considered for Energy System Applications in the 750° C.-800° C. | | | | | | | | | | | | |
|---|---|---|---|---|---|---|---|---|---|---|---|---|
| Alloy | Ni | Co | Cr | Fe | W | Mn | Mo | Nb | Al | Ti | Si | C |
| Current Technology (wrought) | | | | | | | | | | | | |
| Haynes ®282 | 57.52 | 10.2 | 19.06 | 0.77 | 0.04 | 0.08 | 8.25 | 0.03 | 1.83 | 2.07 | 0.06 | 0.06 |
| IN ®740H | 49.32 | 20.19 | 24.97 | 0.2 | 0 | 0.29 | 0.35 | 1.51 | 1.58 | 1.43 | 0.08 | 0.02 |

Other applications may demand cast alloys for use in the temperature range up to about 900° C. in applications such as furnace tubes, furnace rolls, and petrochemical applications. One example of this class of materials is Cast HP-Nb type alloy of the composition. These alloys contain about 35 wt. % Ni and about 25 wt. % Cr with up to ~0.45 wt. % carbon. These obtain their creep resistance through the formation of carbides. They also obtain their oxidation resistance through the formation of chromia scales.

TABLE 2

| Nominal Compositions of State-of-the-art Cast Chromia-forming Alloy | | | | | | | | | |
|---|---|---|---|---|---|---|---|---|---|
| Alloy | Fe | Ni | Cr | Al | Nb | Si | Mo | W | C |
| HP—Nb | Balance | 35 | 25 | 0 | 1.0 | 1.0 | 0 | 0 | 0.45 |
| 35Cr—45Ni | Bal. | 45 | 35 | 0 | 1.0 | 1.0 | — | — | 0.45 |

Most conventional alloys utilize chromia ($Cr_2O_3$) scales for oxidation protection, whereas alumina ($Al_2O_3$) scales offer the potential for order-of-magnitude greater oxidation resistance, as well as enhanced thermodynamic stability and durability in environments containing aggressive oxidizing species such as $H_2O$, C, and S.

The inherently slower oxide growth rate of alumina-forming alloys is significantly advantageous in heat exchanger applications, where thin-walled components or ligaments are frequently encountered, and oxidation-driven metal consumption can be a life-limiting factor. The temperature above which alumina-formers are favored over chromia formers depends on component thickness, component lifetime, and exposure gases. For example, oxidation of chromia-forming alloys is greatly accelerated in the presence of combustion gases containing water vapor due to Cr oxy-hydroxide volatilization. Under these condition, alumina-formers become of interest above ~650-700° C. In sCO2 without appreciable H2O or S impurities, or in air, alumina formers become of interest above ~750-800° C. The drawback is that alumina-forming alloys are more challenging to achieve strength and ductility due to interference of strengthening mechanisms by Al, particularly as the high levels of Al typically needed to form $Al_2O_3$ tend to stabilize both weak BCC phases and brittle, albeit strong, intermetallic phases. Aluminum additions also interfere with N-based strengthening approaches.

SUMMARY OF THE INVENTION

An austenitic Ni-base alloy, comprising, in weight percent:

2.5 to 4.75 Al;
13 to 21 Cr;
20 to 40 Fe;
2.0 to 5.0 total of at least one element selected from the group consisting of Nb and Ta;
0.25 to 4.5 Ti;
0.09 to 1.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.45 C;
0.005 to 0.1 B;
0 to 0.05 P;
less than 0.06 N; and
Ni balance (38 to 47 Ni);

wherein the weight percent Ni is greater than the weight percent Fe, wherein said alloy forms an external continuous scale comprising alumina and has a stable phase FCC austenitic matrix microstructure, said austenitic matrix being essentially delta-ferrite-free, and contains one or more carbides and coherent precipitates of γ' and exhibits a creep rupture lifetime of at least 100 h at 900° C. and 50 MPa.

An austenitic Ni-base alloy, consisting essentially of, in weight percent:

2.5 to 4.75 Al;
13 to 21 Cr;
20 to 40 Fe;
2.0 to 5.0 total of at least one element selected from the group consisting of Nb and Ta;
0.25 to 4.5 Ti;
0.09 to 1.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.2 C;
0.005 to 0.1 B;
0 to 0.05 P;
less than 0.06 N; and
Ni balance (38 to 47 Ni);

wherein the weight percent Ni is greater than the weight percent Fe, wherein said alloy forms an external continuous scale comprising alumina and has a stable phase FCC austenitic matrix microstructure, said austenitic matrix being essentially delta-ferrite-free, and contains one or more carbides and coherent precipitates of γ' and exhibits a creep rupture lifetime of at least 200 h at 900° C. and 50 MPa.

An austenitic Ni-base alloy, comprising, in weight percent:

3.0 to 4.00 Al;
14 to 20 Cr;
23 to 35 Fe;
2.0 to 5.0 total of at least one element selected from the group consisting of Nb and Ta;
0.25 to 3.5 Ti;
0.09 to 0.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.2 C;
0.005 to 0.1 B;
0 to 0.05 P;
less than 0.06 N; and
Ni balance (38 to 47 Ni);

wherein the weight percent Ni is greater than the weight percent Fe, wherein said alloy forms an external continuous scale comprising alumina and has a stable phase FCC austenitic matrix microstructure, said austenitic matrix being essentially delta-ferrite-free, and contains one or more carbides and coherent precipitates of γ' and exhibits a creep rupture lifetime of at least 500 h at 900° C. and 50 MPa.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
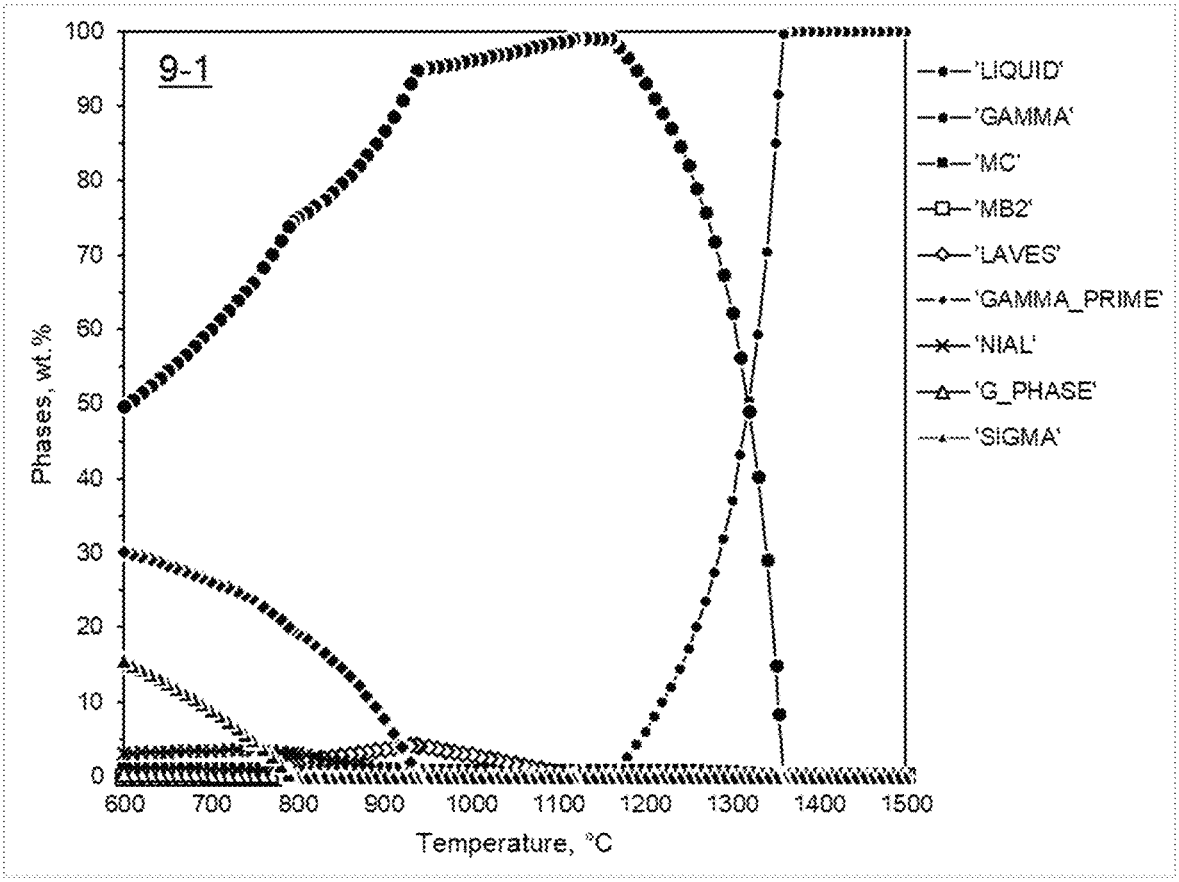
FIG. 1 shows a calculated equilibrium phase diagram for alloy 9-1.
Figure 2:
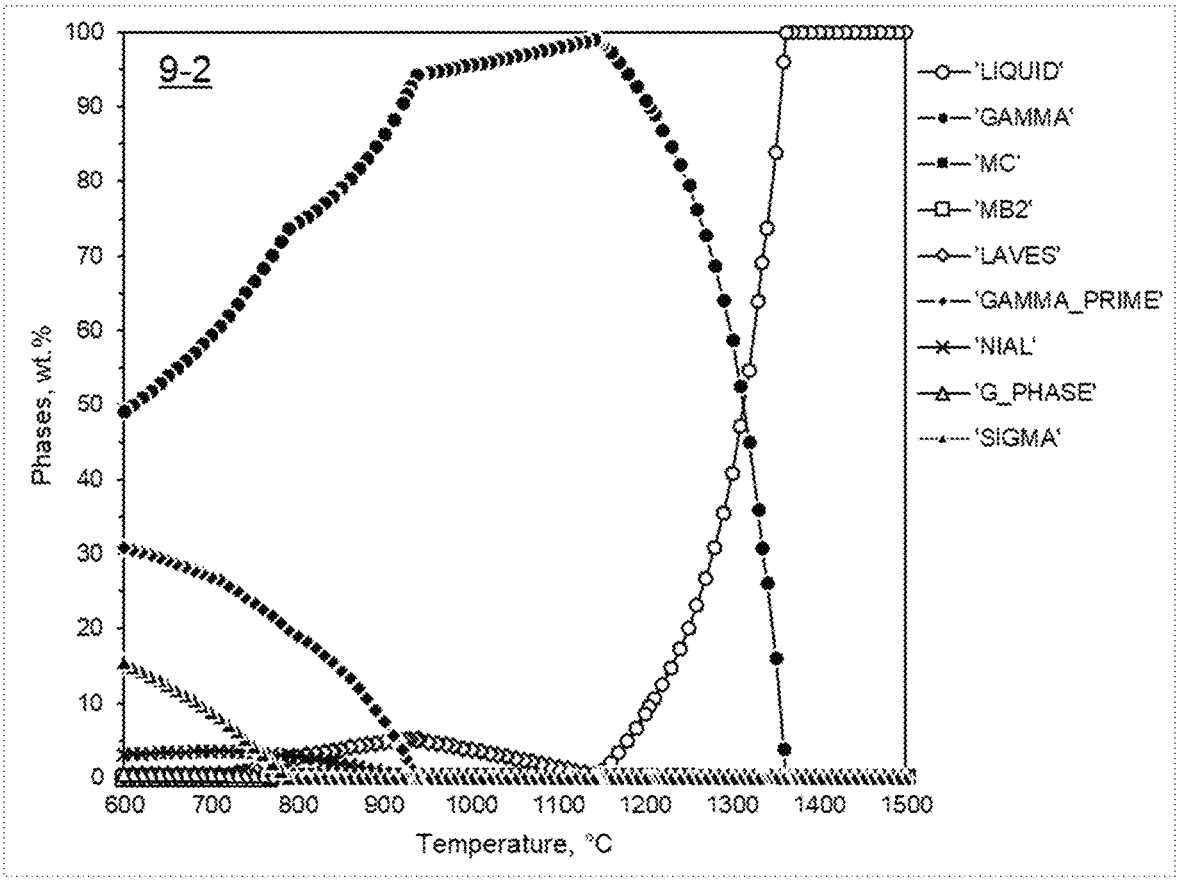
FIG. 2 shows a calculated equilibrium phase diagram for alloy 9-2.
Figure 3:
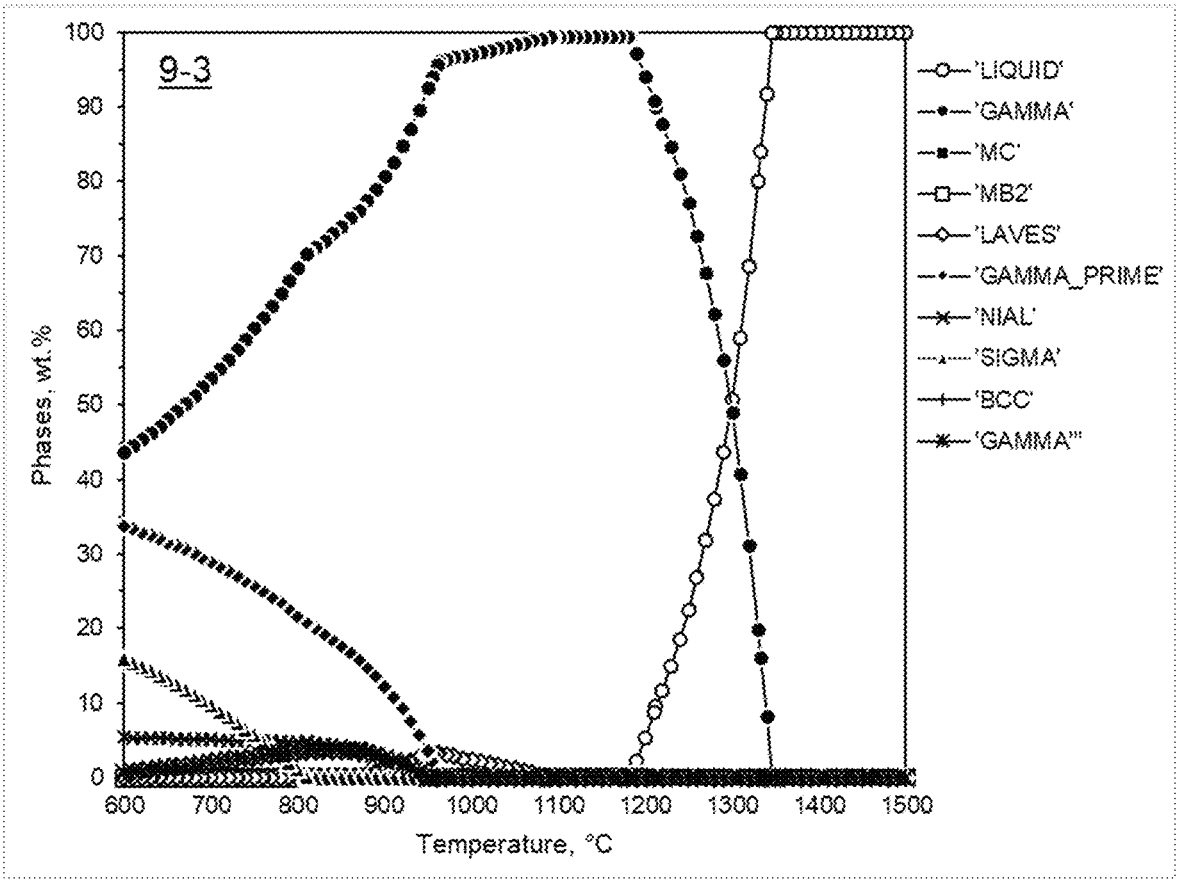
FIG. 3 shows a calculated equilibrium phase diagram for alloy 9-3.
Figure 4:
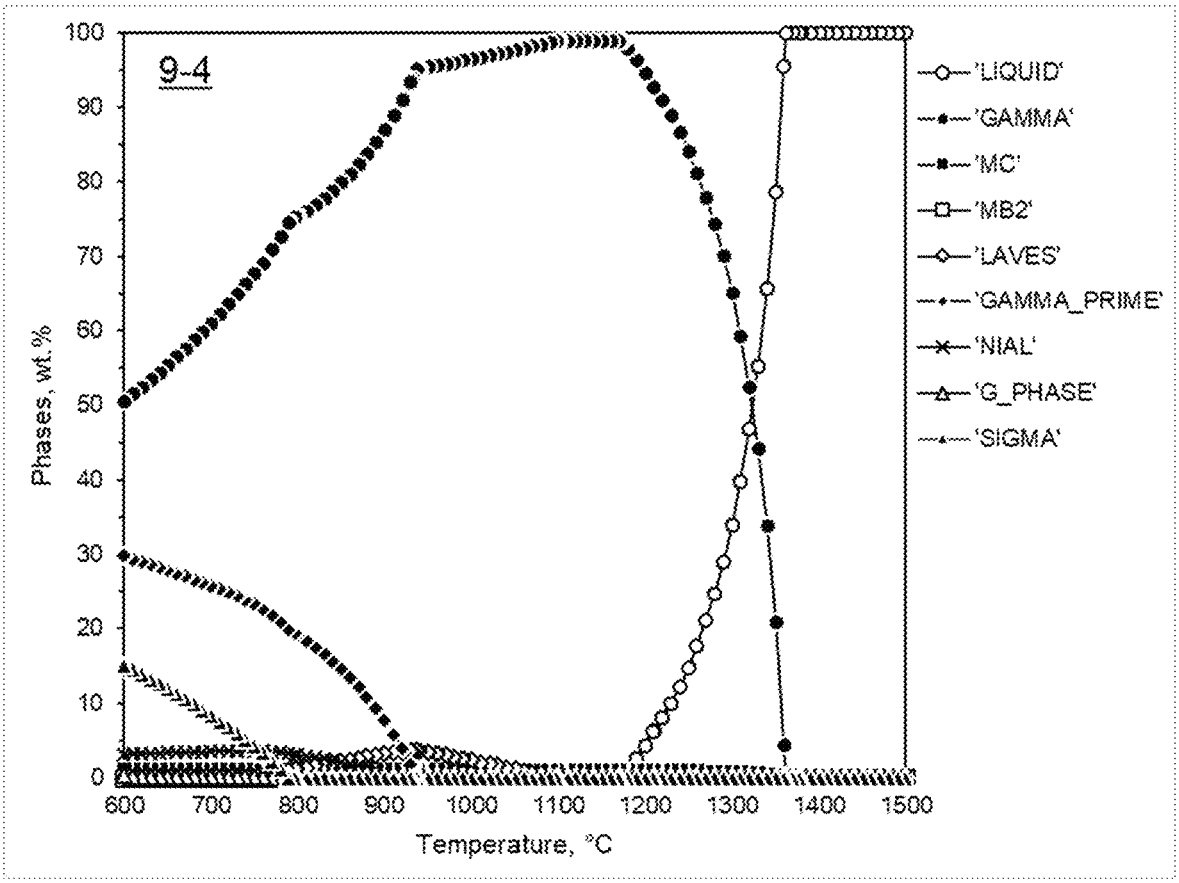
FIG. 4 shows a calculated equilibrium phase diagram for alloy 9-4.
Figure 5:
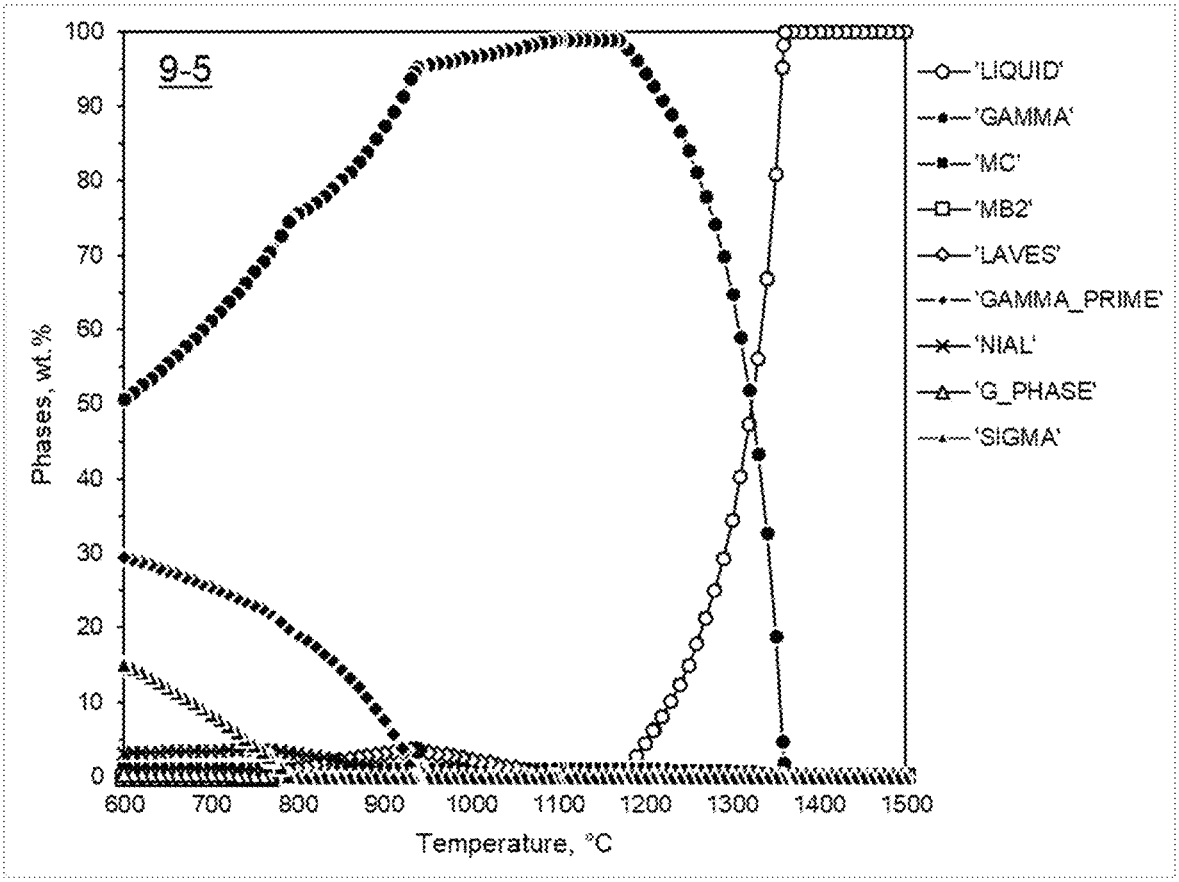
FIG. 5 shows a calculated equilibrium phase diagram for alloy 9-5.
Figure 6:
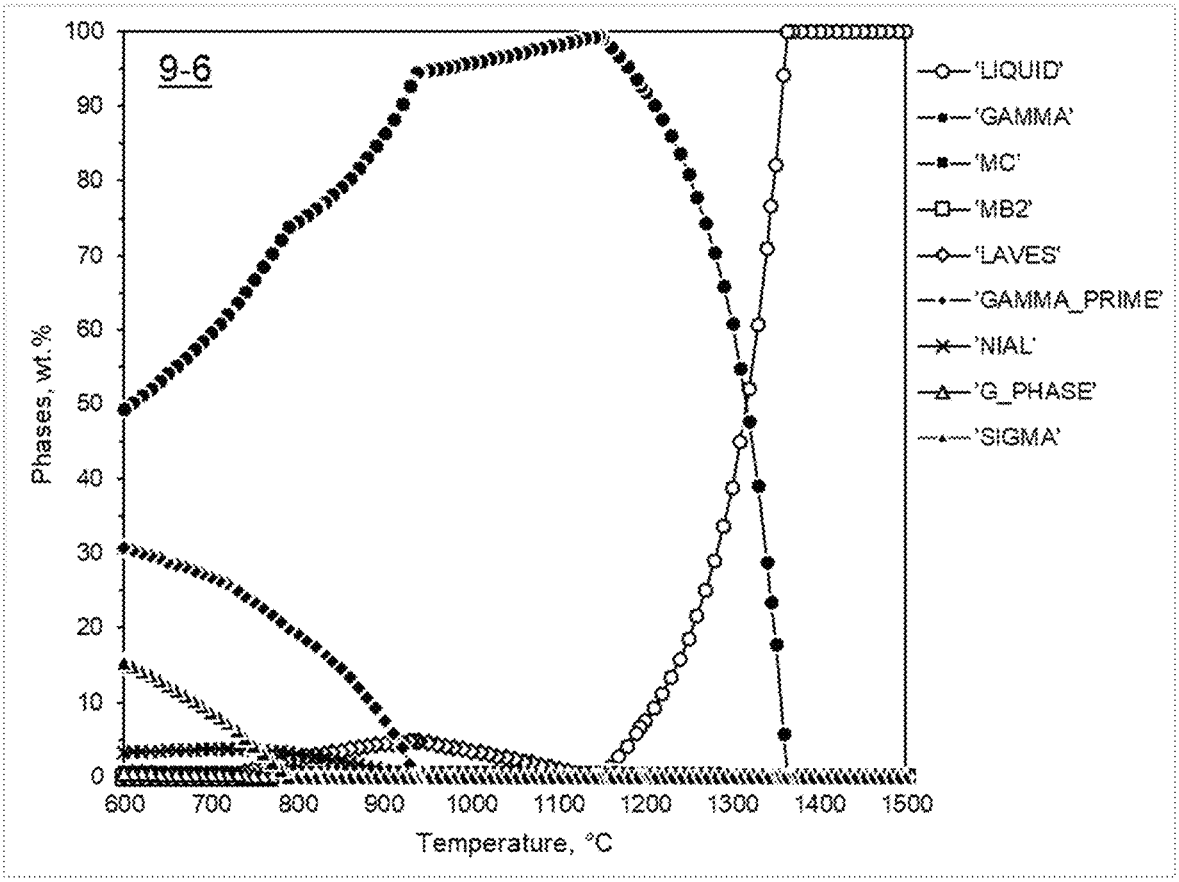
FIG. 6 shows a calculated equilibrium phase diagram for alloy 9-6.
Figure 7:
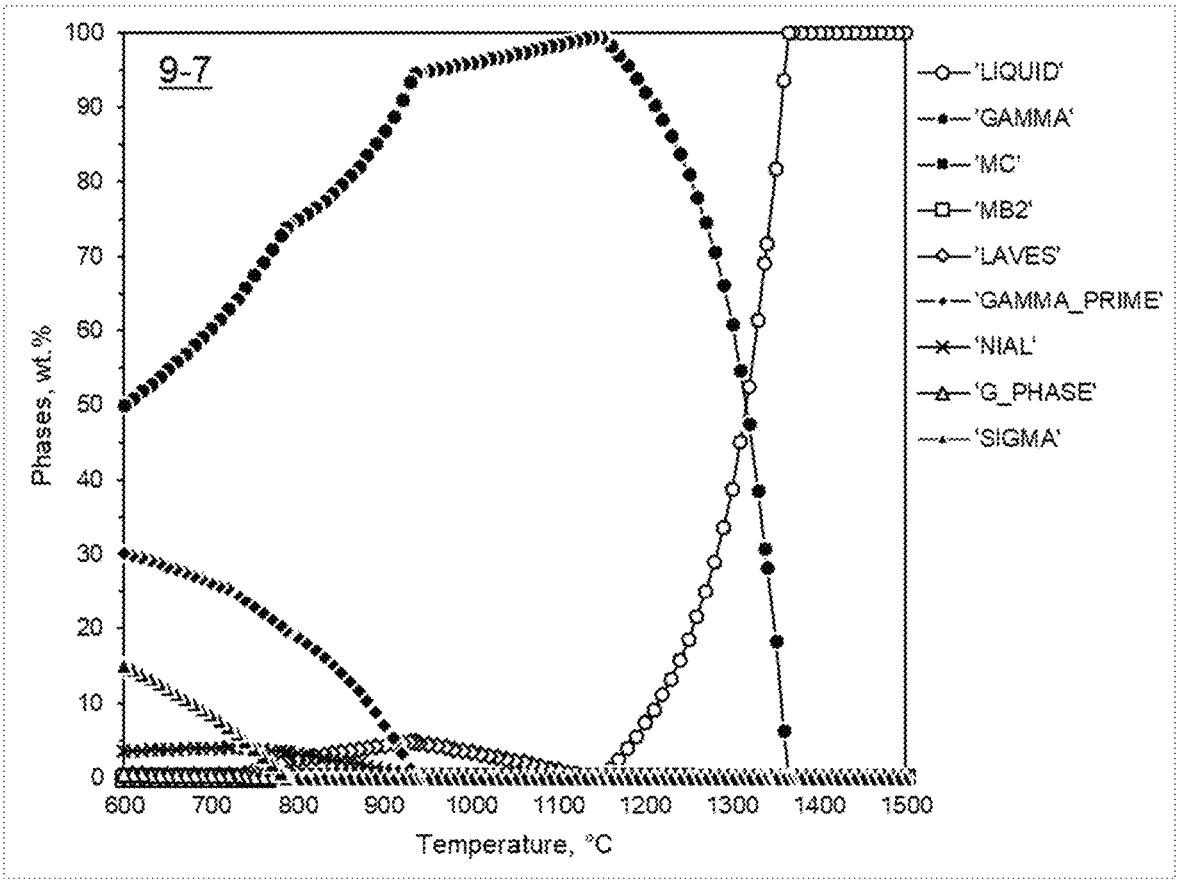
FIG. 7 shows a calculated equilibrium phase diagram for alloy 9-7.
Figure 8:
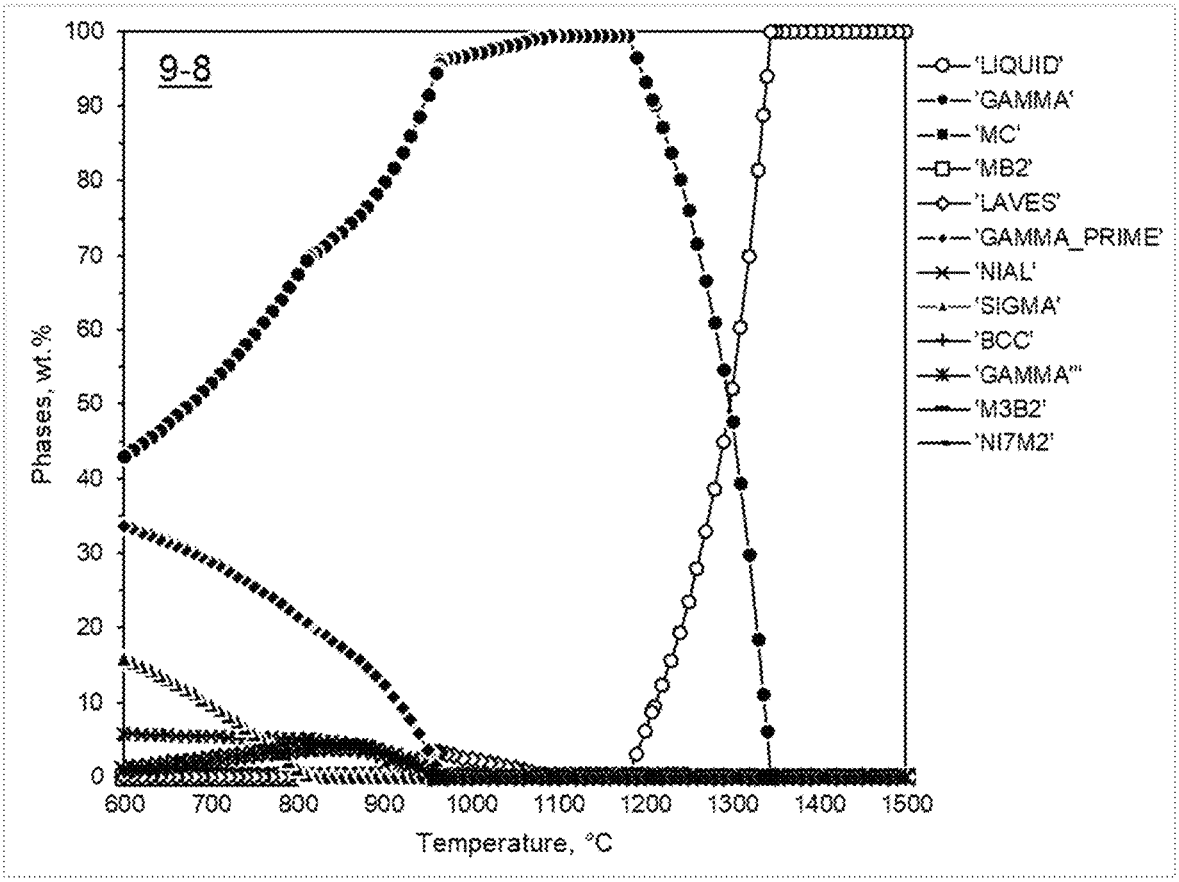
FIG. 8 shows a calculated equilibrium phase diagram for alloy 9-8.
Figure 9:
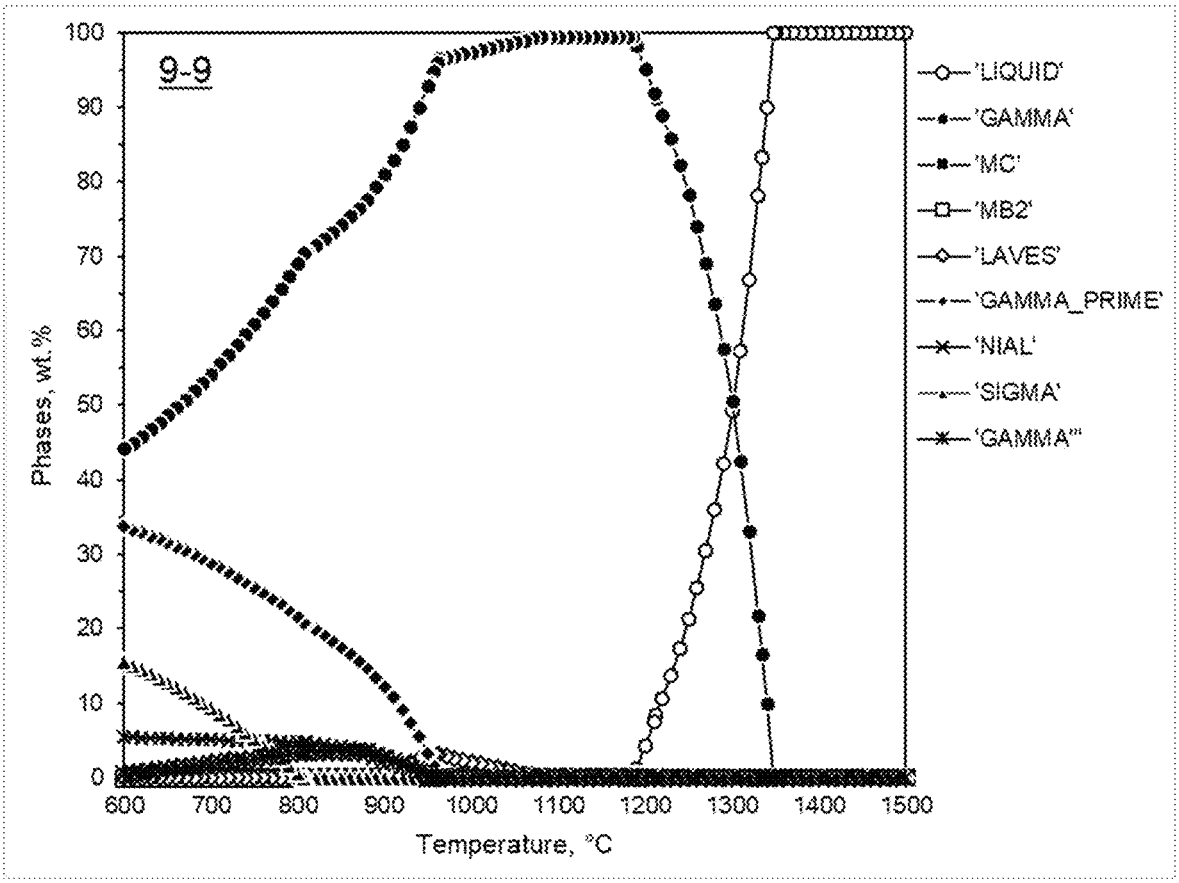
FIG. 9 shows a calculated equilibrium phase diagram for alloy 9-9.
Figure 10:
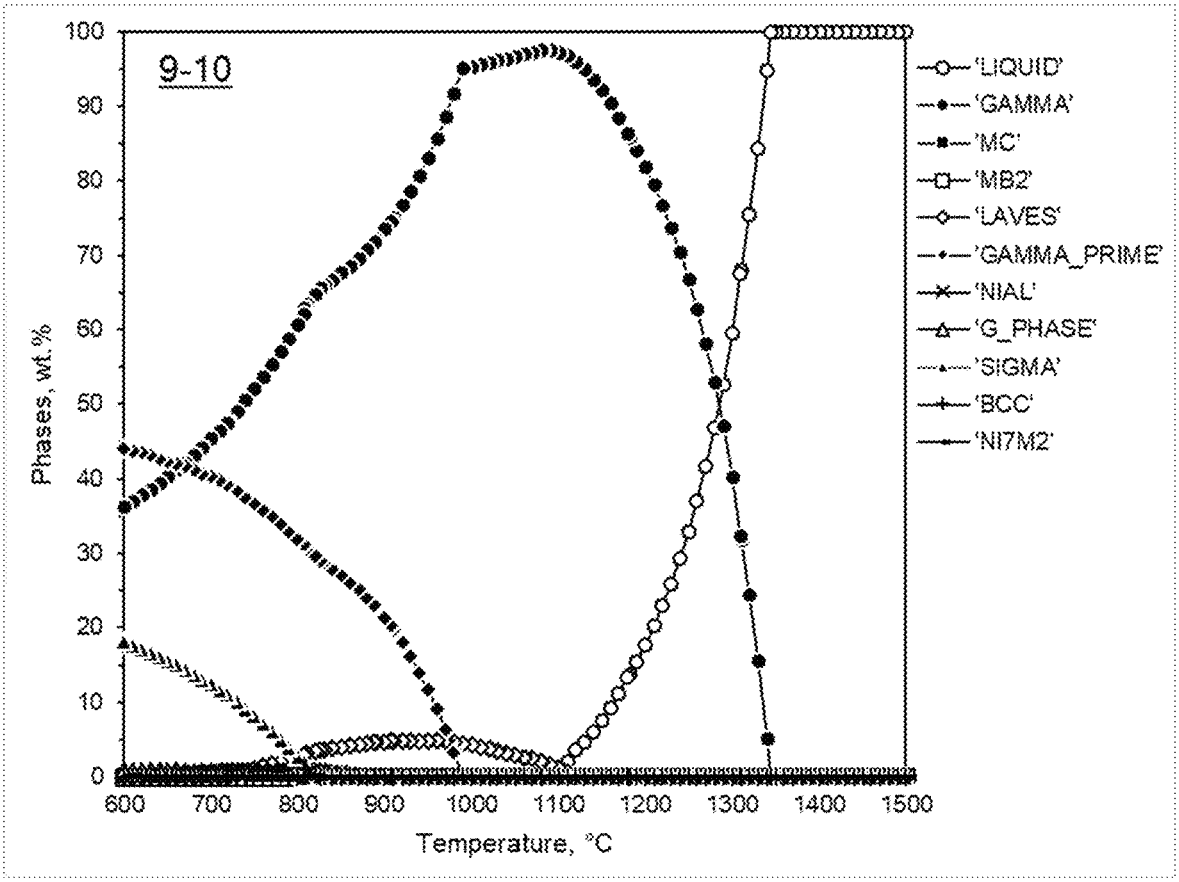
FIG. 10 shows a calculated equilibrium phase diagram for alloy 9-10.
Figure 11:
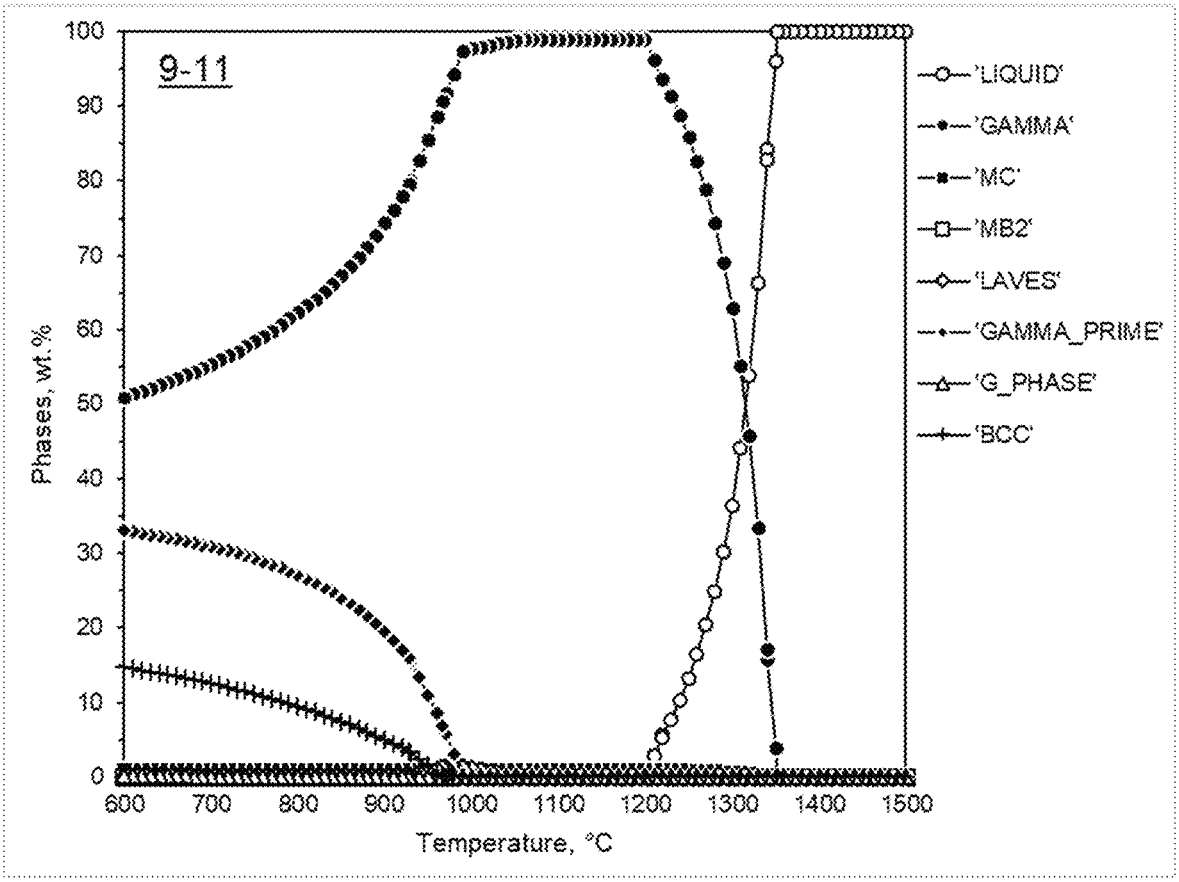
FIG. 11 shows a calculated equilibrium phase diagram for alloy 9-11.
Figure 12:
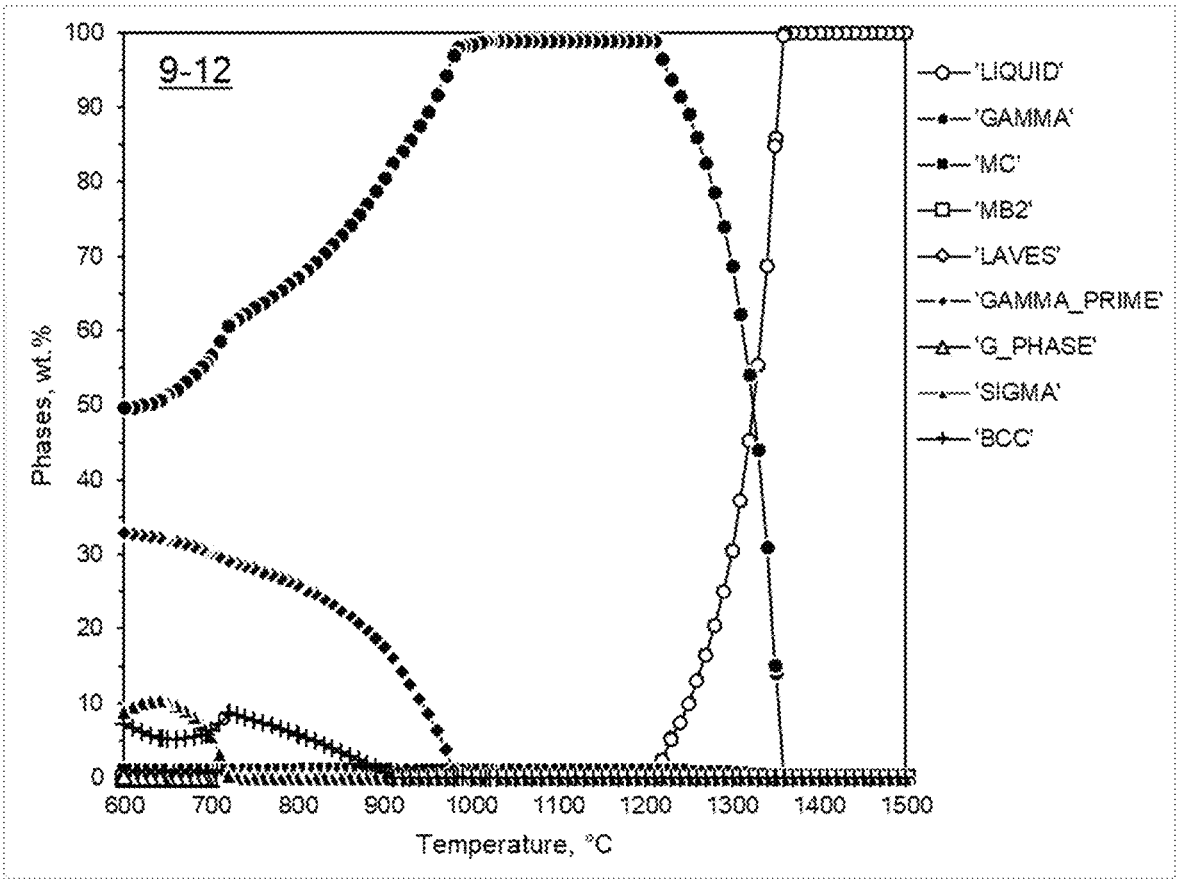
FIG. 12 shows a calculated equilibrium phase diagram for alloy 9-12.
Figure 13:
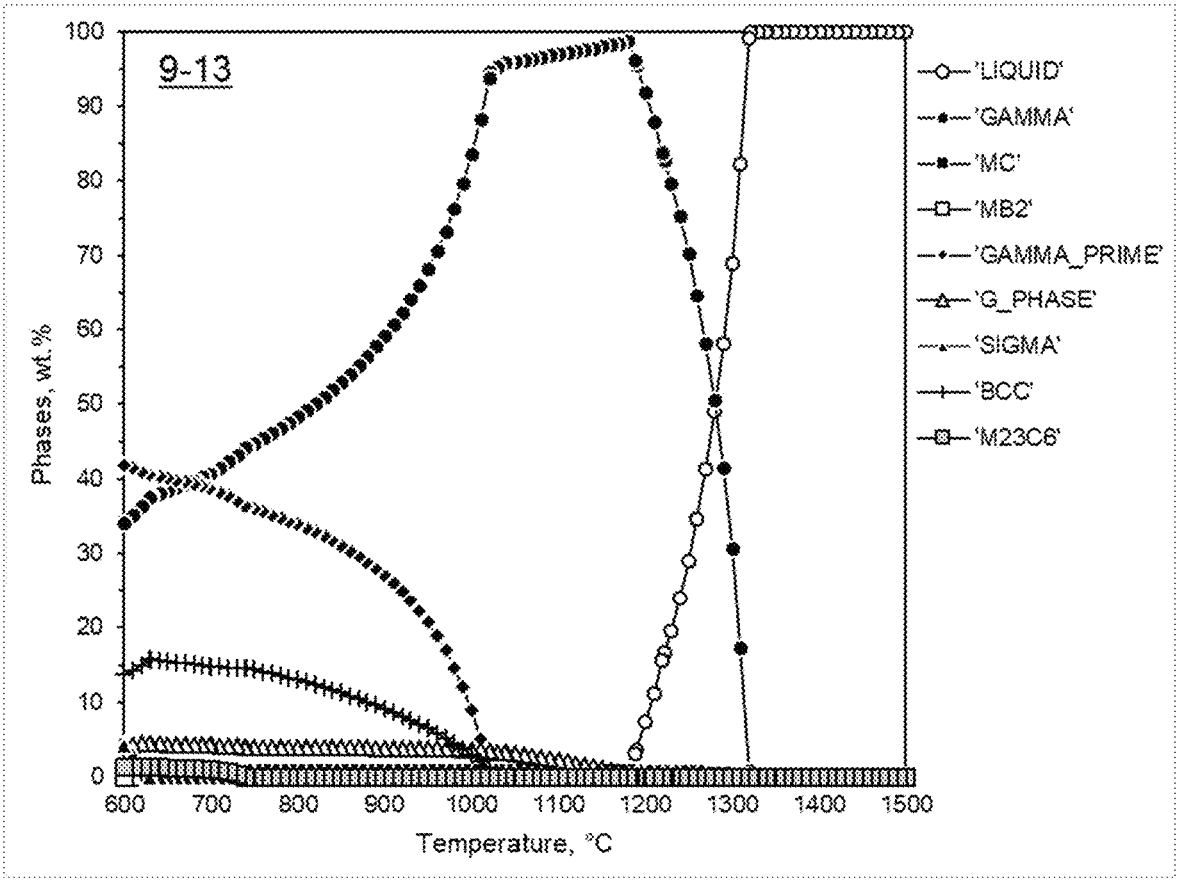
FIG. 13 shows a calculated equilibrium phase diagram for alloy 9-13.
Figure 14:
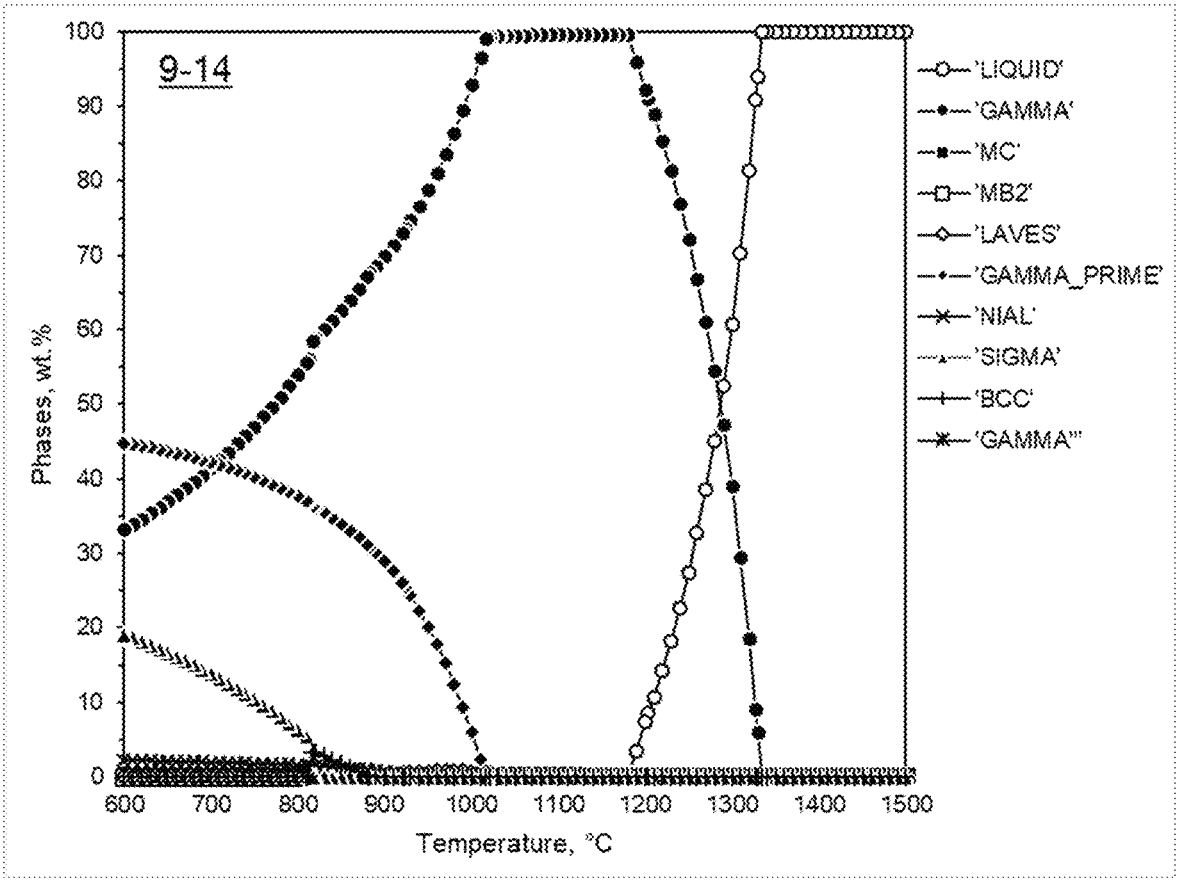
FIG. 14 shows a calculated equilibrium phase diagram for alloy 9-14.
Figure 15:
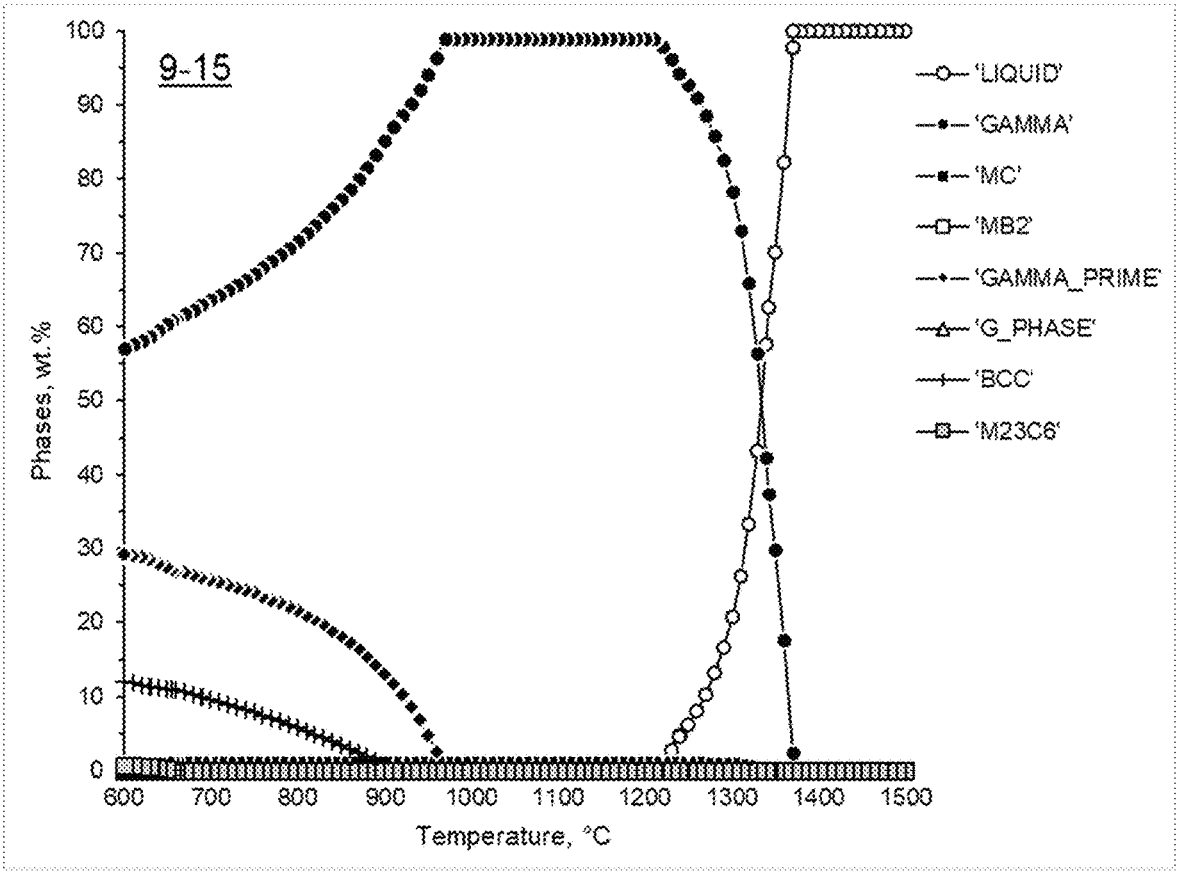
FIG. 15 shows a calculated equilibrium phase diagram for alloy 9-15.
Figure 16:
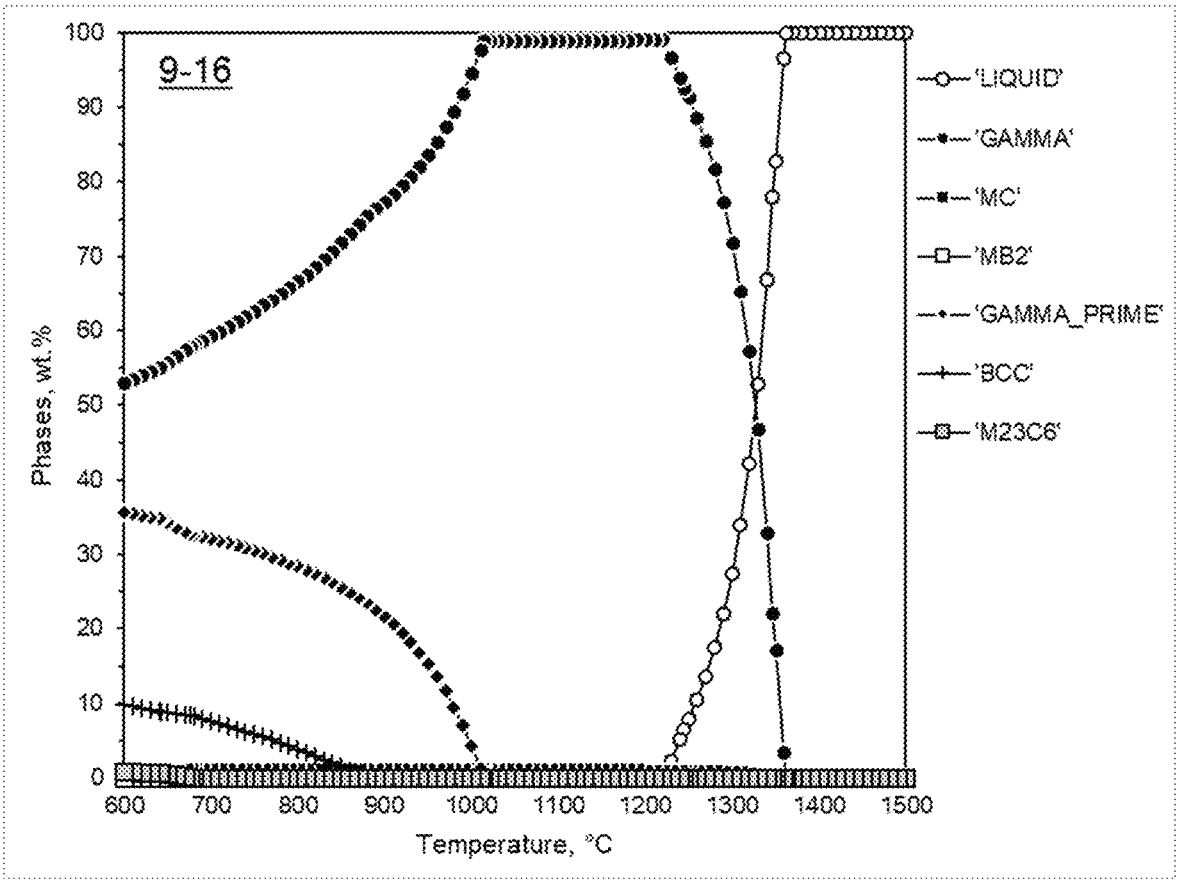
FIG. 16 shows a calculated equilibrium phase diagram for alloy 9-16.
Figure 17:
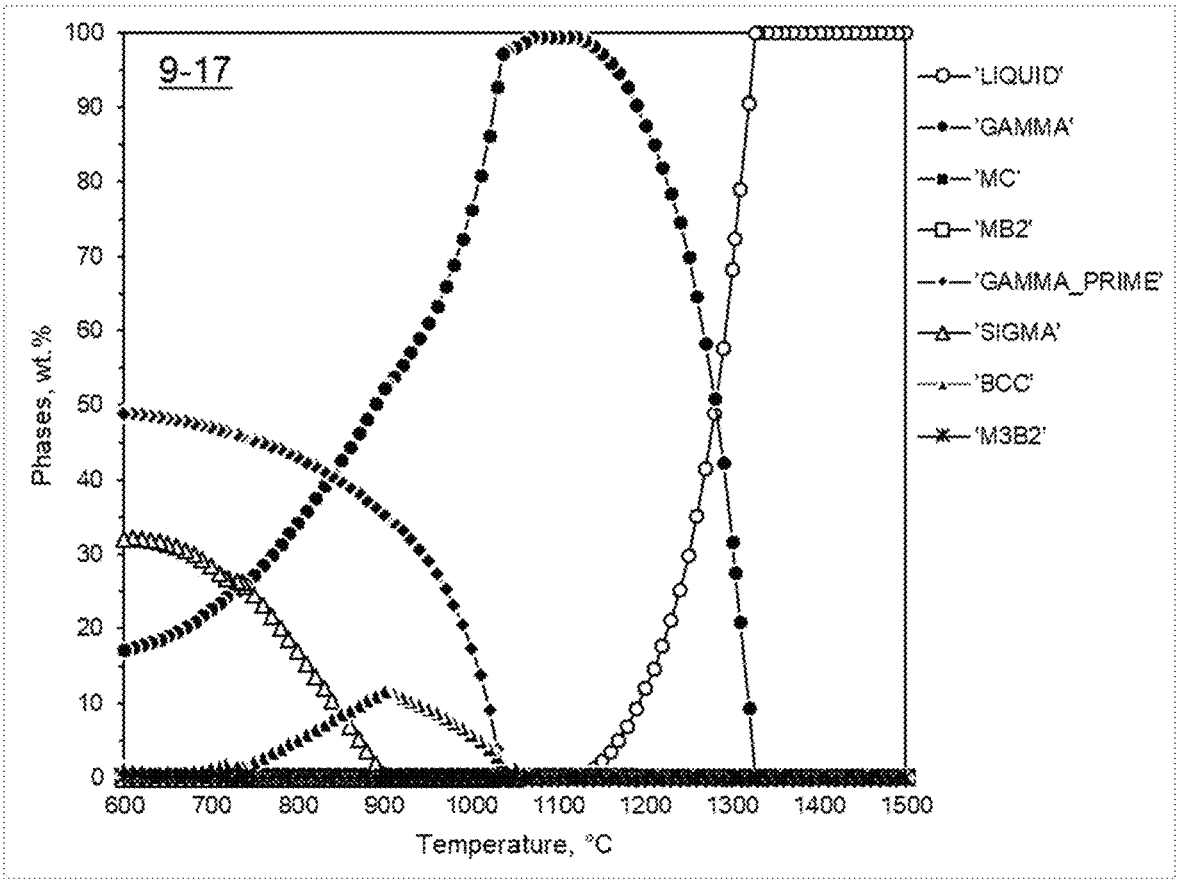
FIG. 17 shows a calculated equilibrium phase diagram for alloy 9-17.
Figure 18:
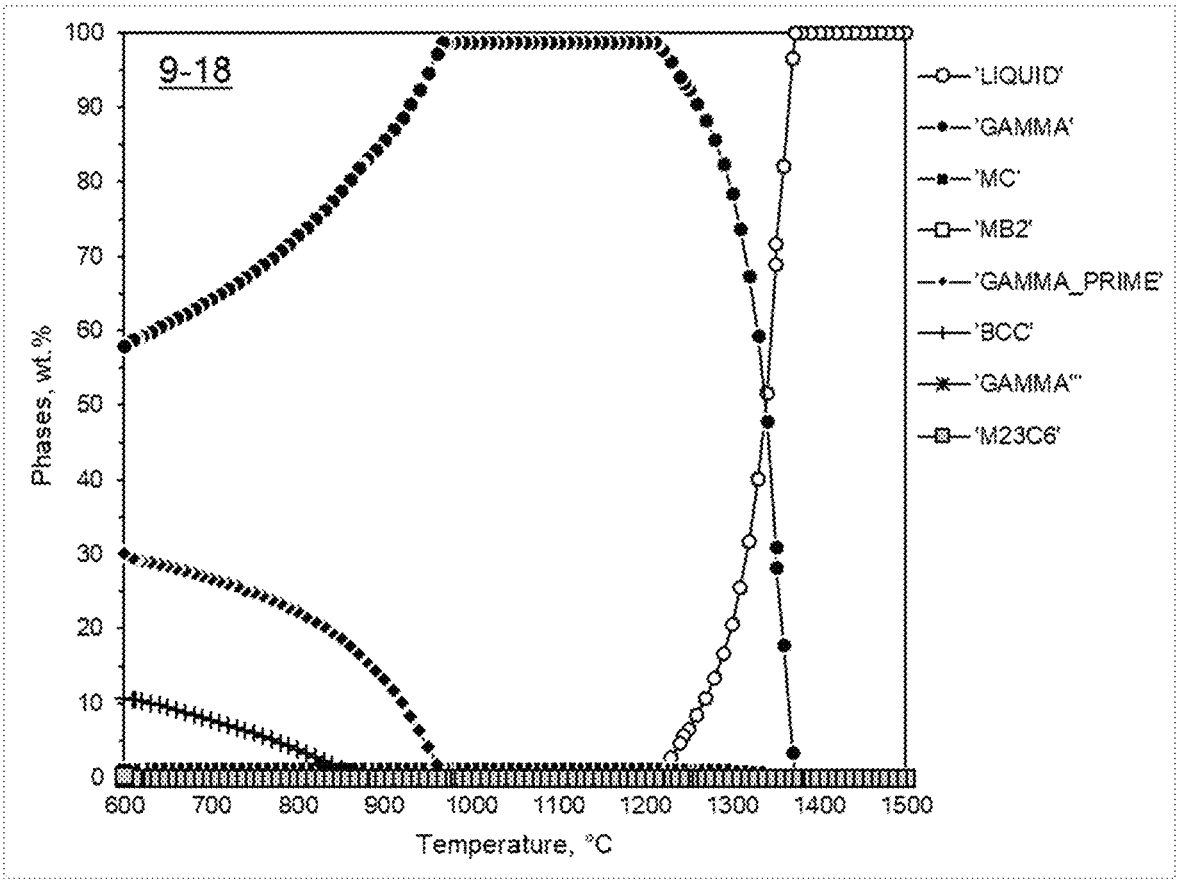
FIG. 18 shows a calculated equilibrium phase diagram for alloy 9-18.
Figure 19:
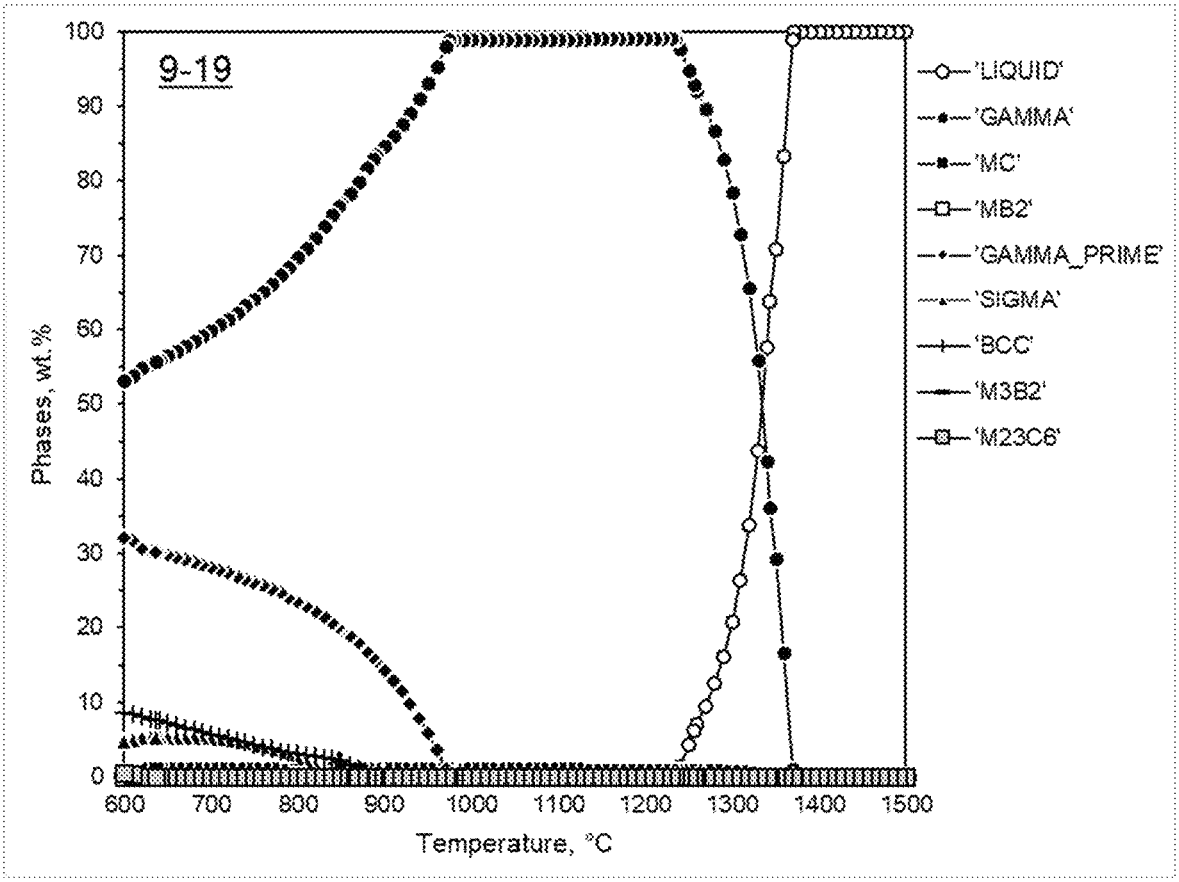
FIG. 19 shows a calculated equilibrium phase diagram for alloy 9-19.
Figure 20:
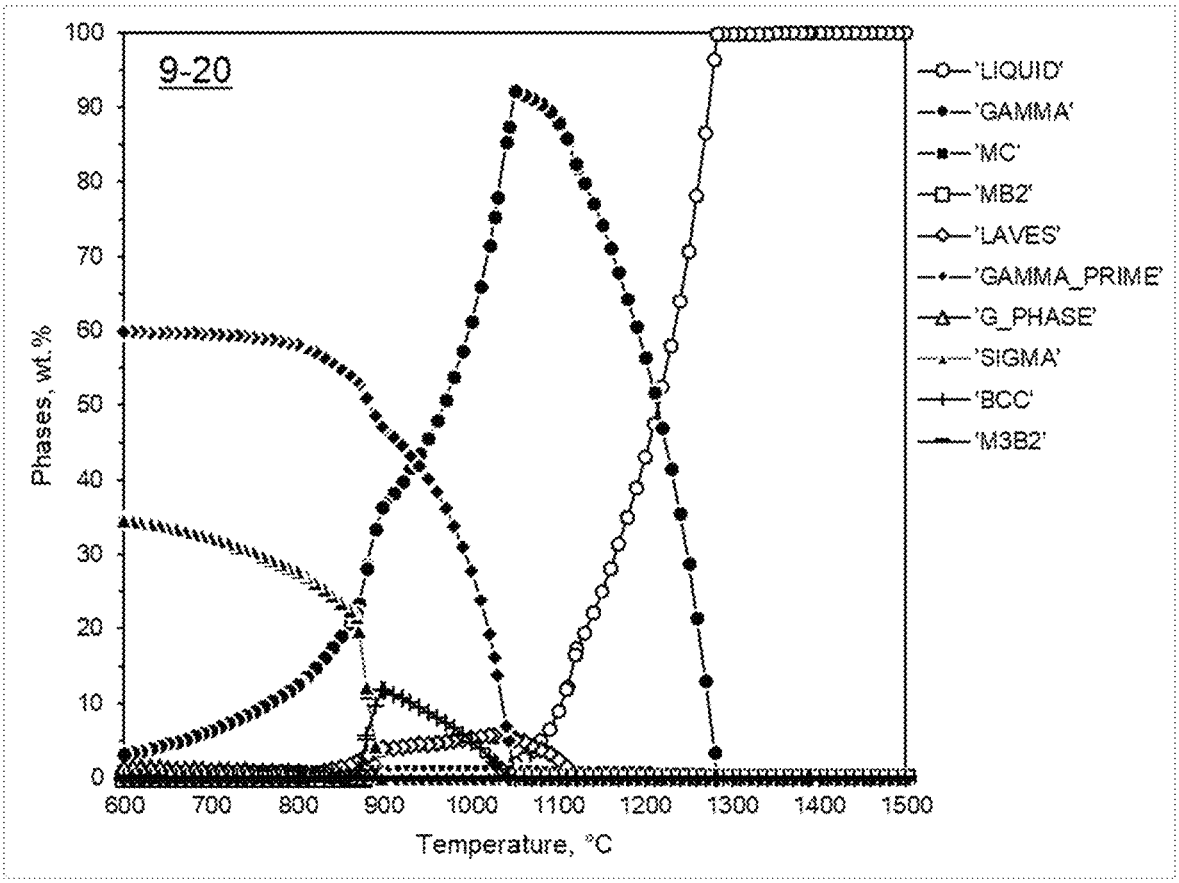
FIG. 20 shows a calculated equilibrium phase diagram for alloy 9-20.
Figure 21:
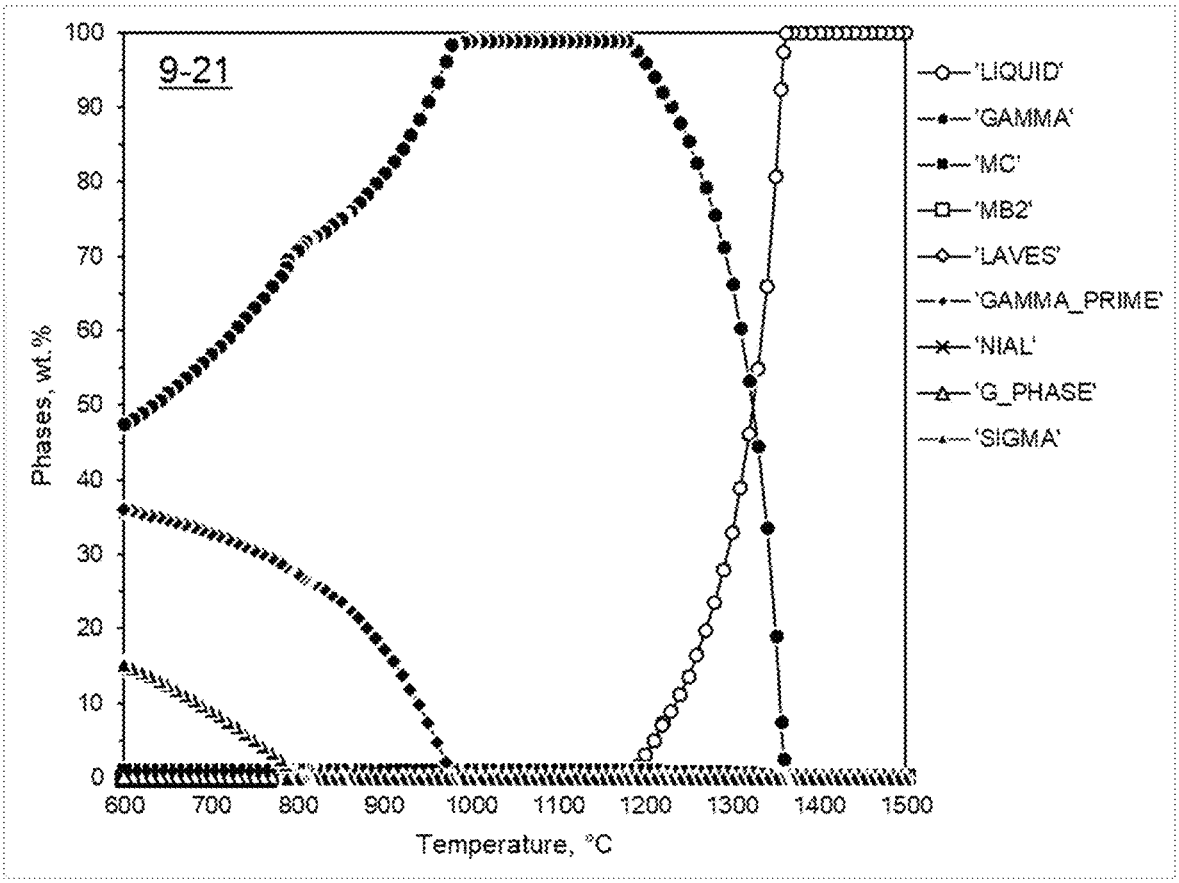
FIG. 21 shows a calculated equilibrium phase diagram for alloy 9-21.
Figure 22:
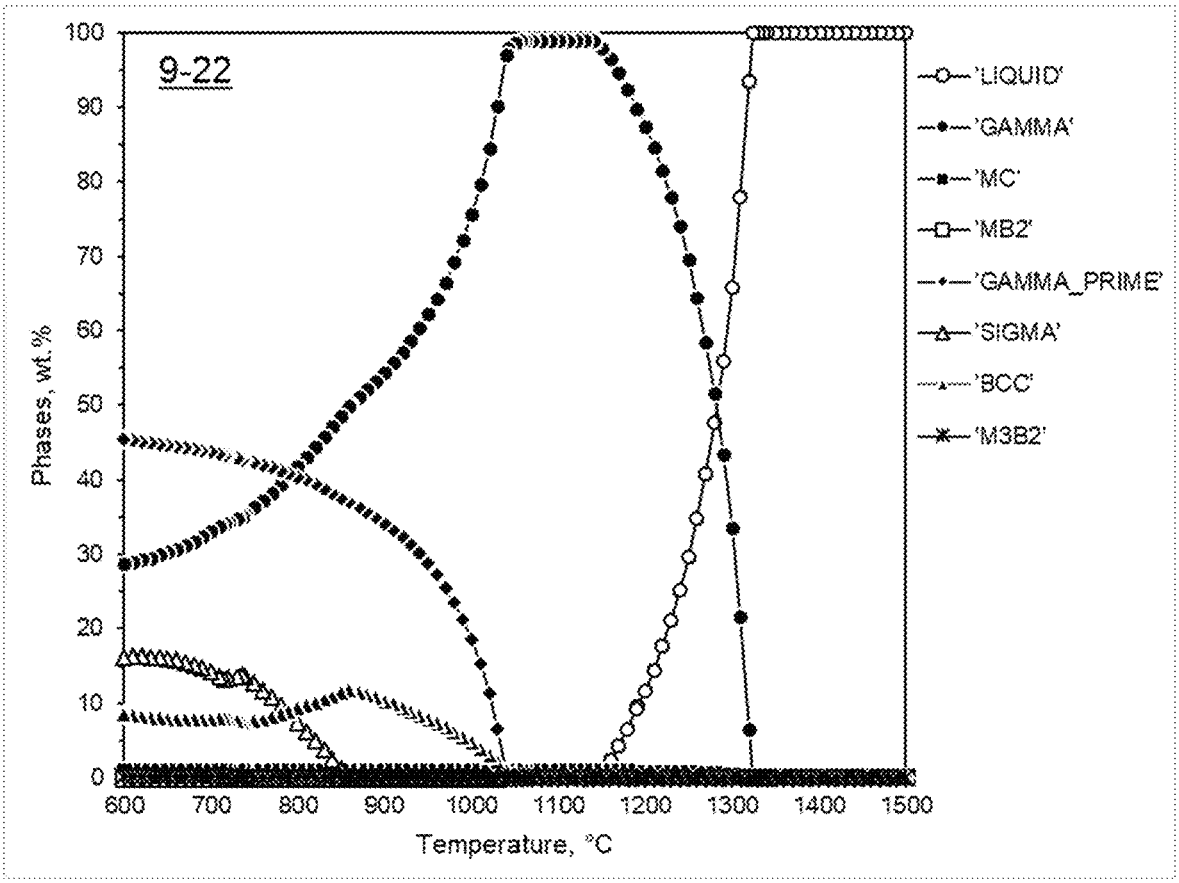
FIG. 22 shows a calculated equilibrium phase diagram for alloy 9-22.
Figure 23:
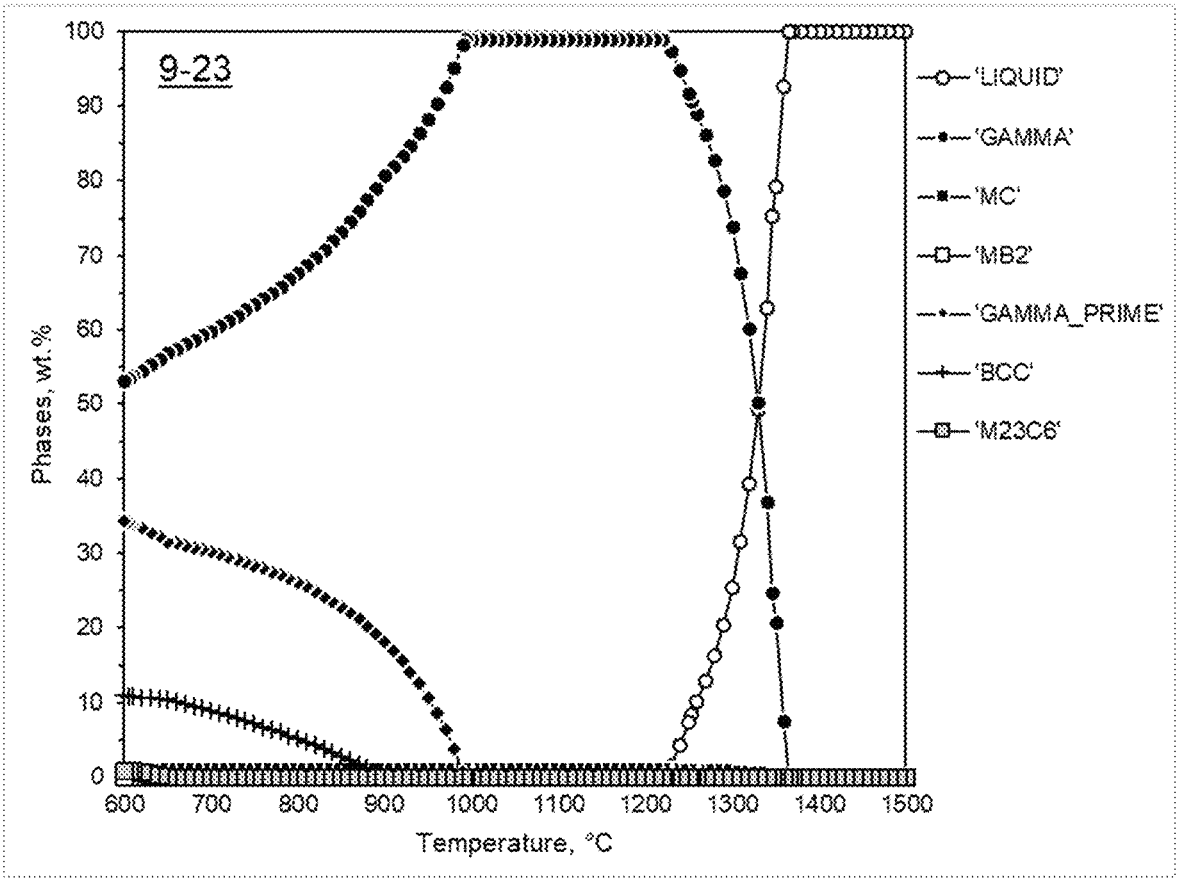
FIG. 23 shows a calculated equilibrium phase diagram for alloy 9-23.
Figure 24:
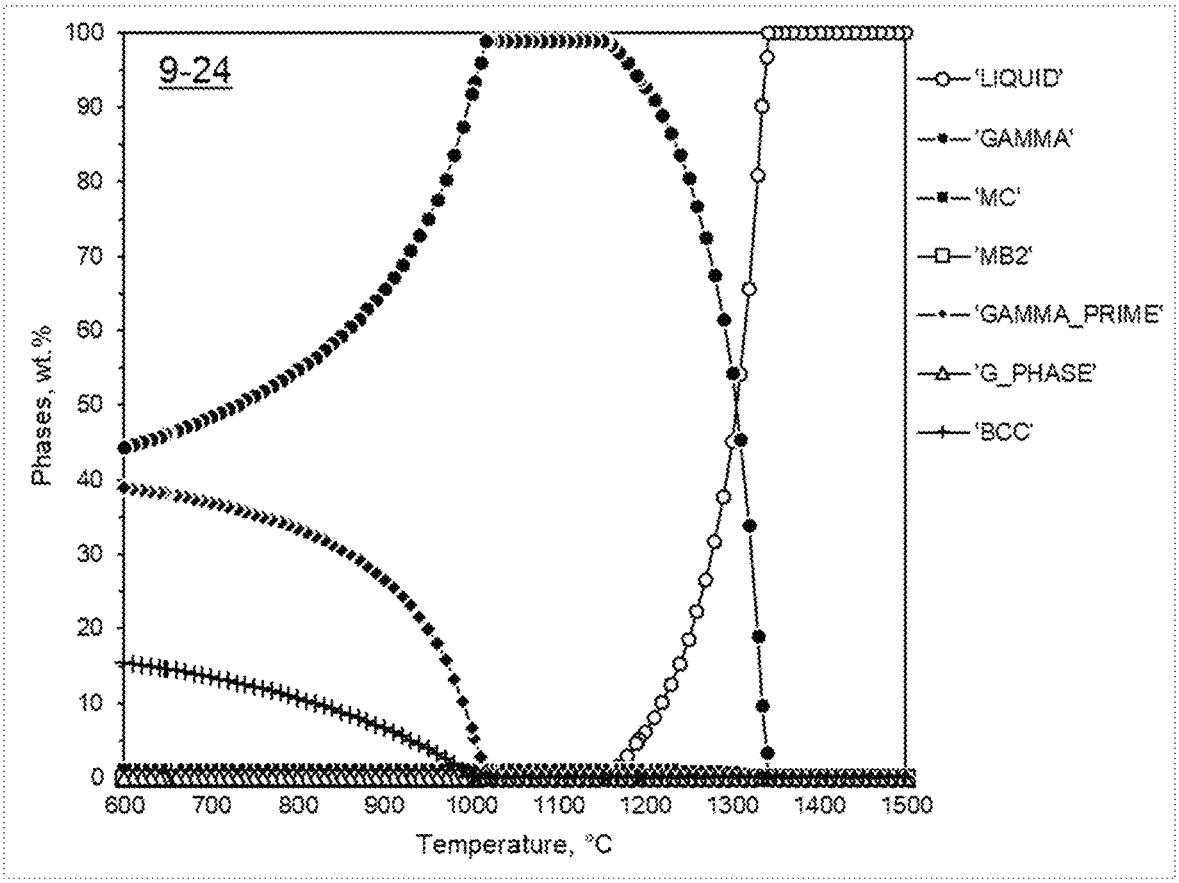
FIG. 24 shows a calculated equilibrium phase diagram for alloy 9-24.
Figure 25:
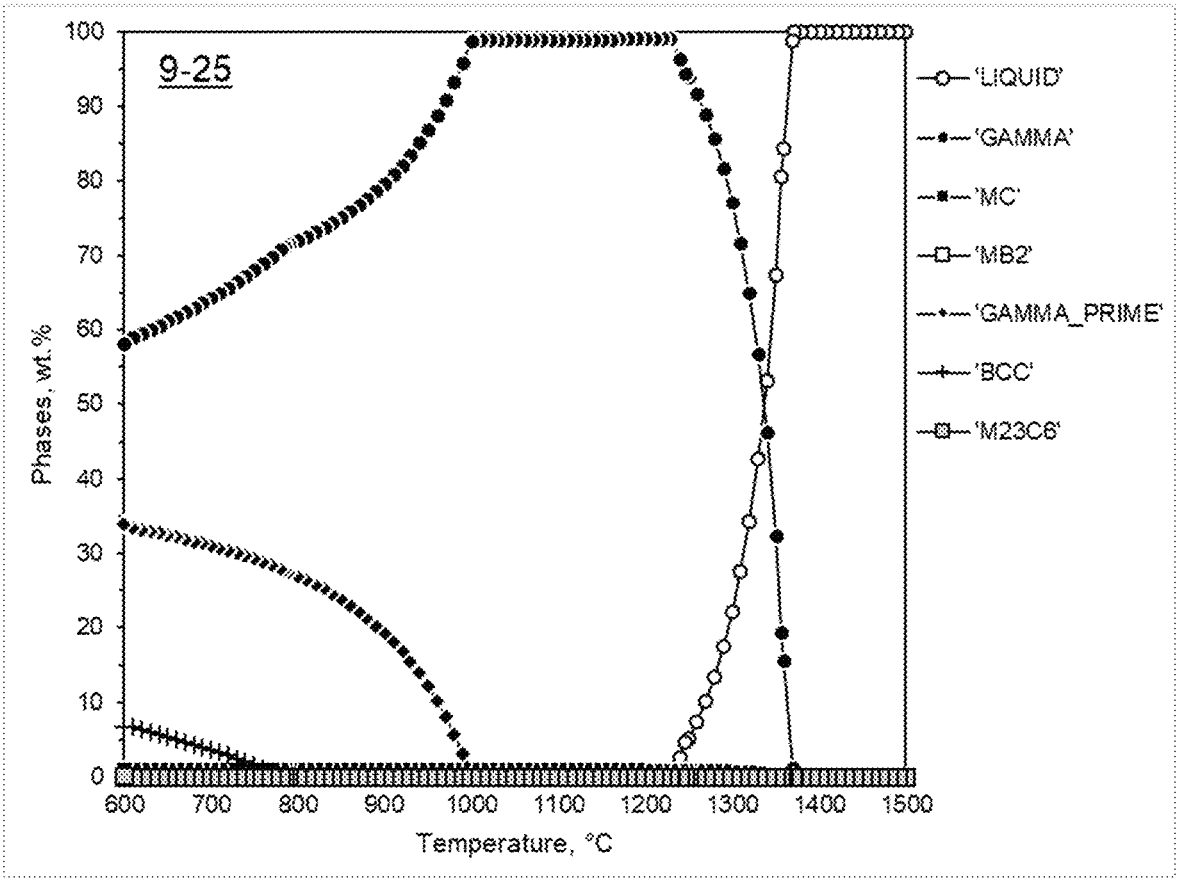
FIG. 25 shows a calculated equilibrium phase diagram for alloy 9-25.
Figure 26:
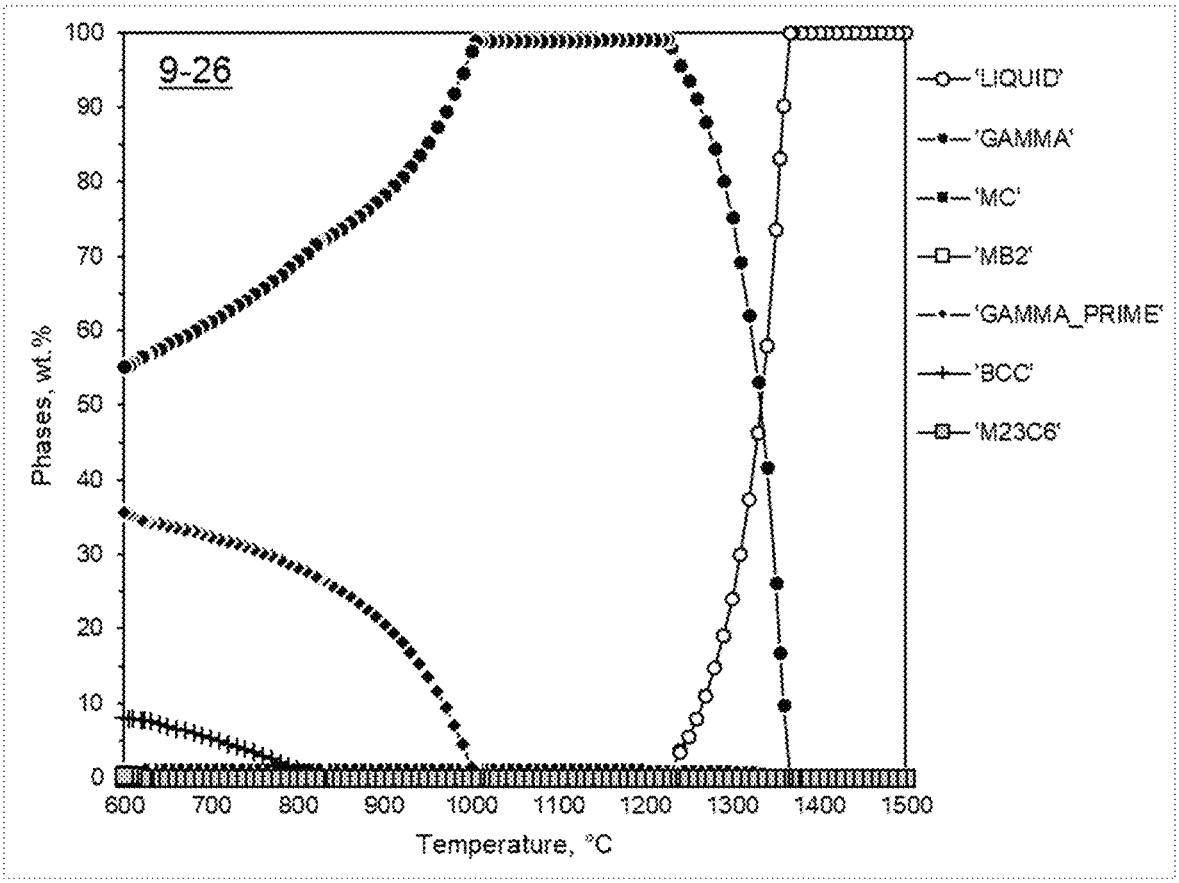
FIG. 26 shows a calculated equilibrium phase diagram for alloy 9-26.
Figure 27:
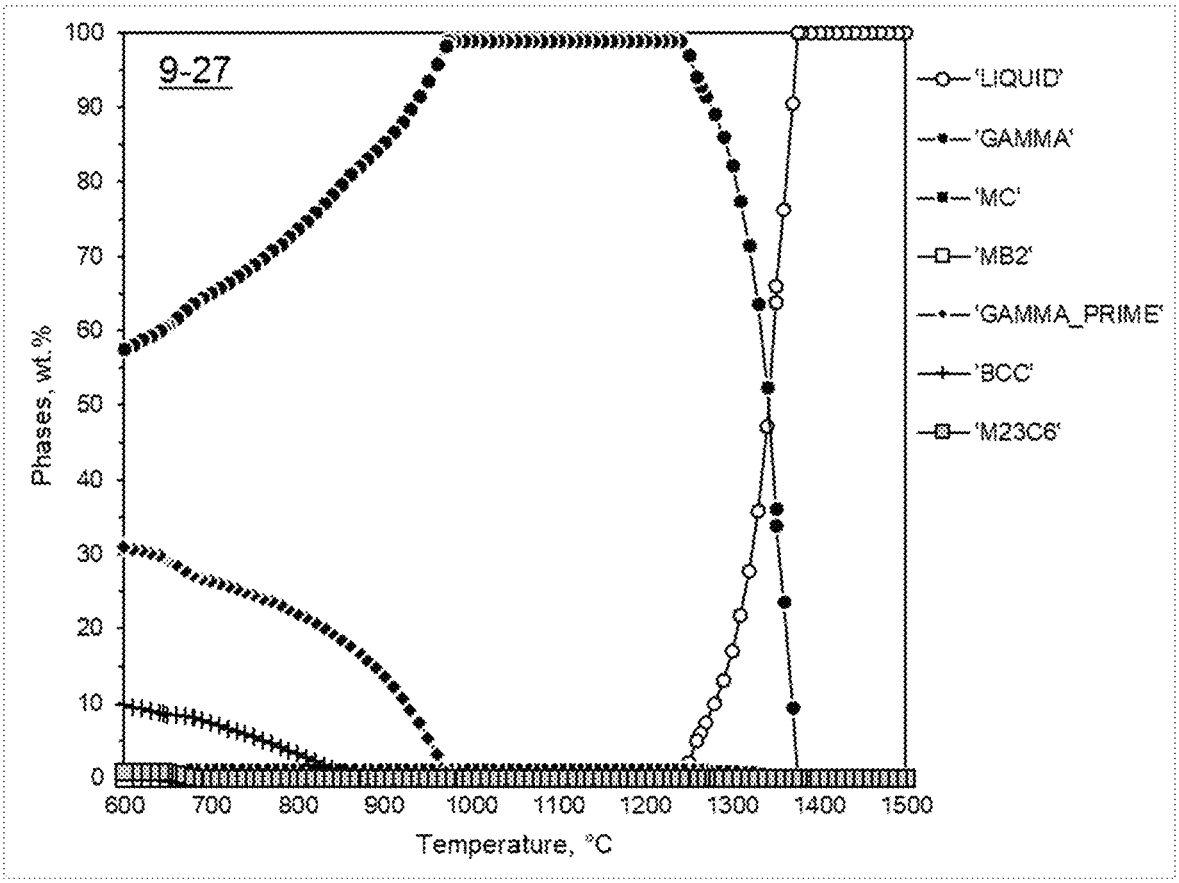
FIG. 27 shows a calculated equilibrium phase diagram for alloy 9-27.
Figure 28:
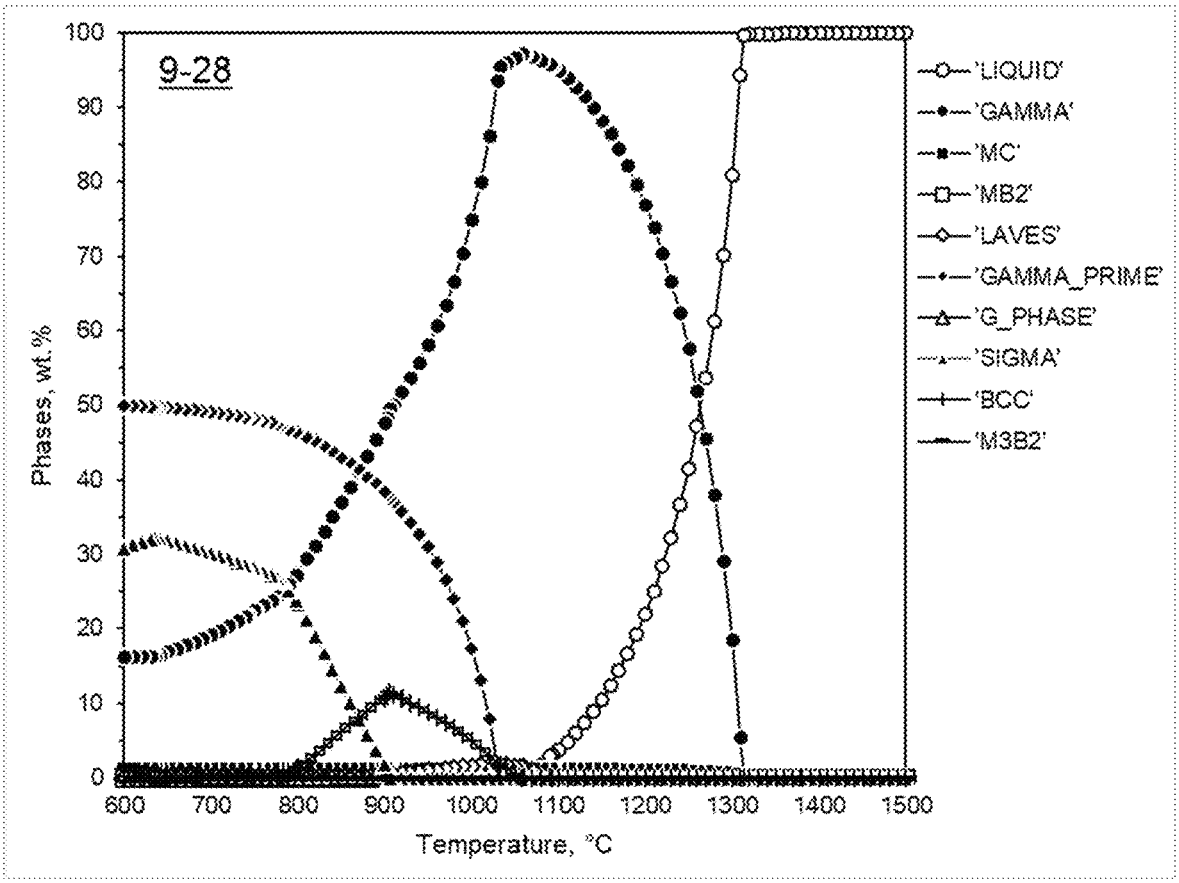
FIG. 28 shows a calculated equilibrium phase diagram for alloy 9-28.
Figure 29:
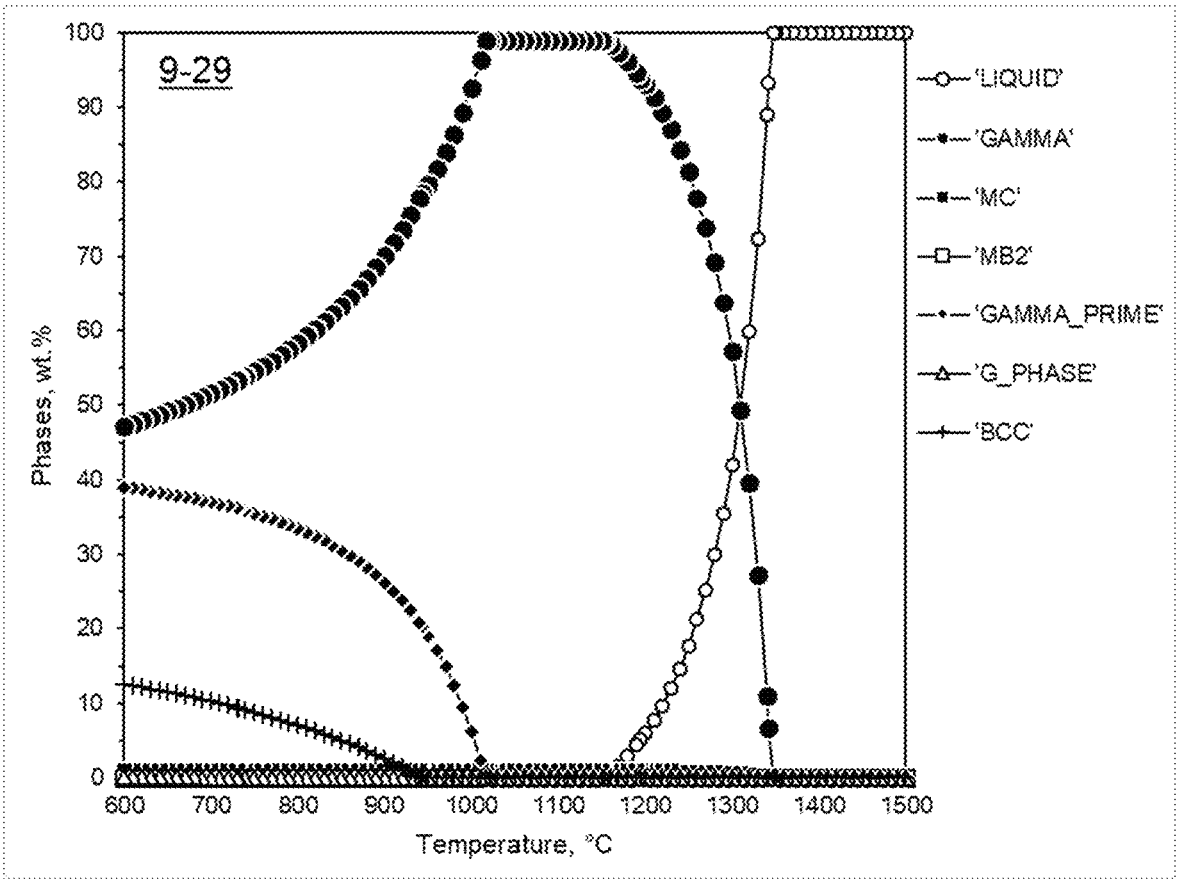
FIG. 29 shows a calculated equilibrium phase diagram for alloy 9-29.
Figure 30:
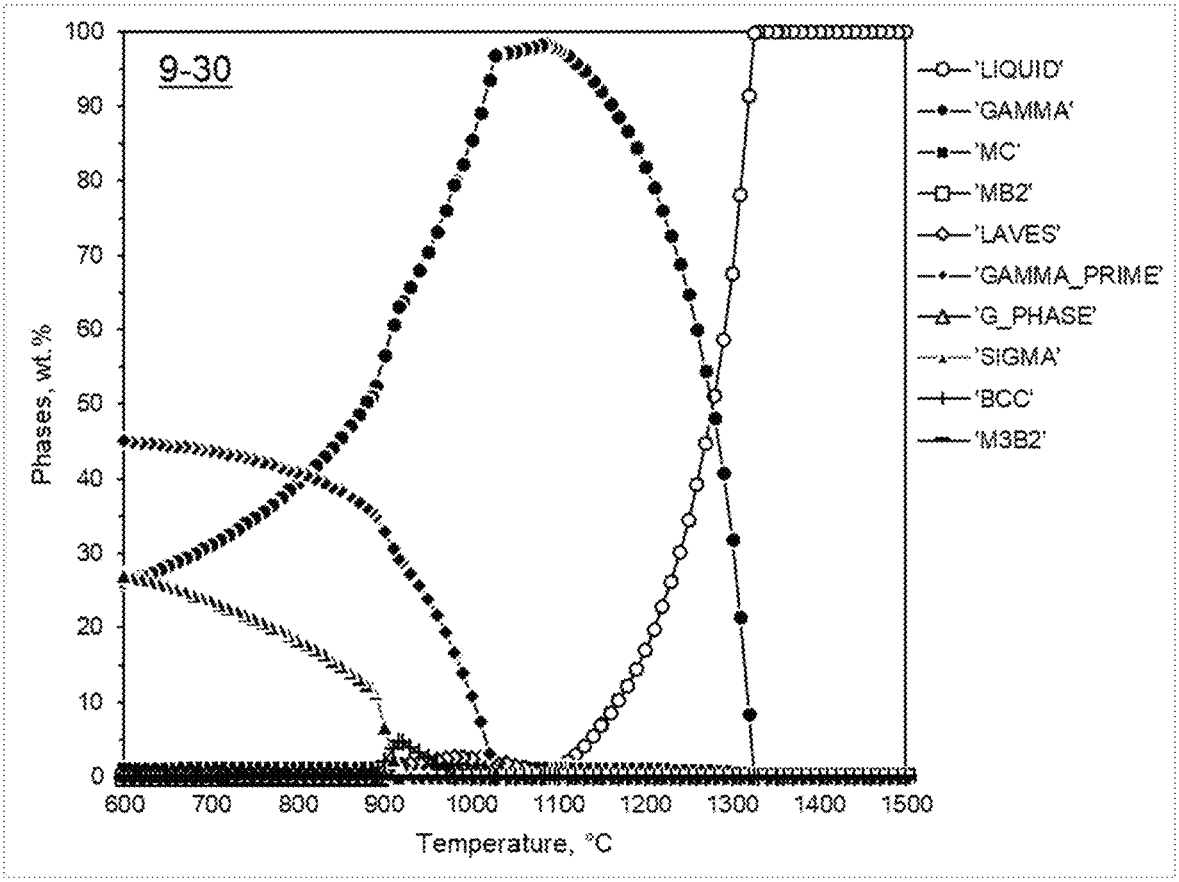
FIG. 30 shows a calculated equilibrium phase diagram for alloy 9-30.
Figure 31:
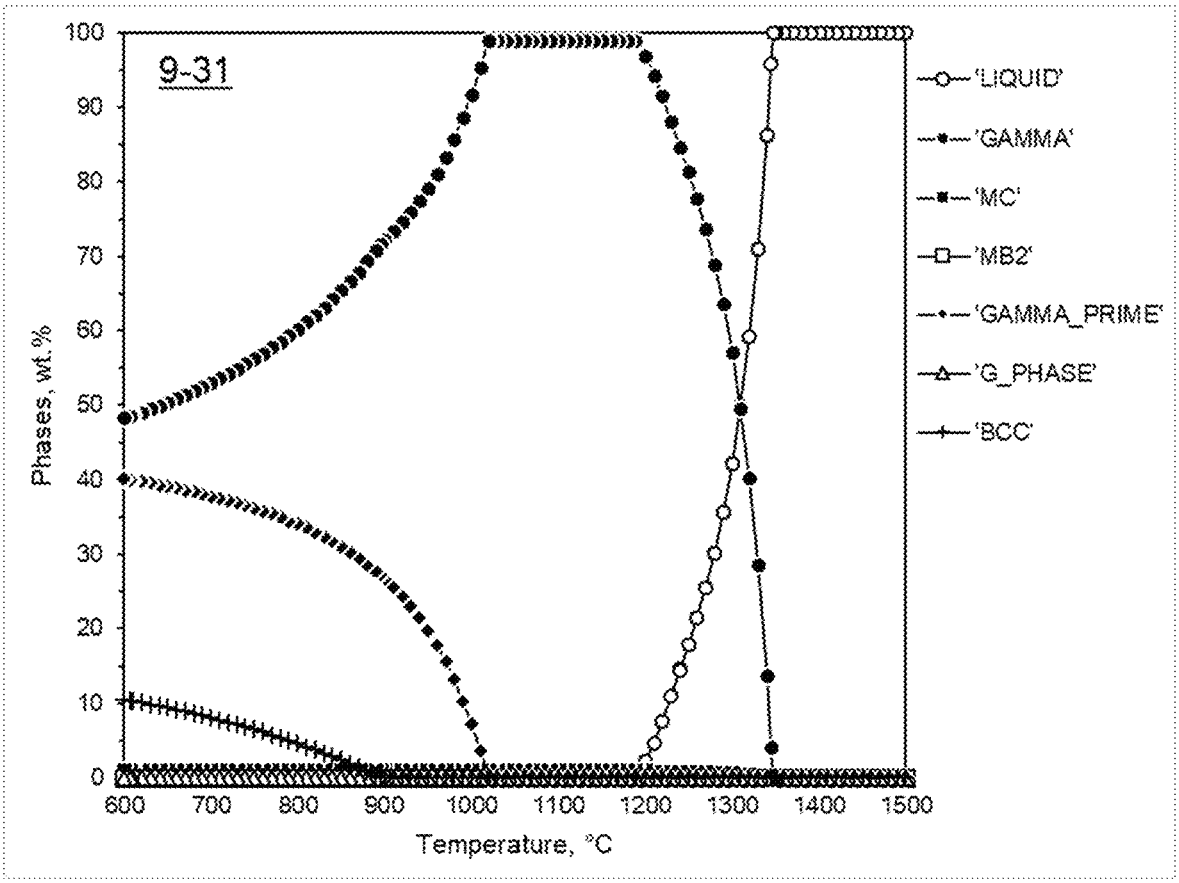
FIG. 31 shows a calculated equilibrium phase diagram for alloy 9-31.
Figure 32:
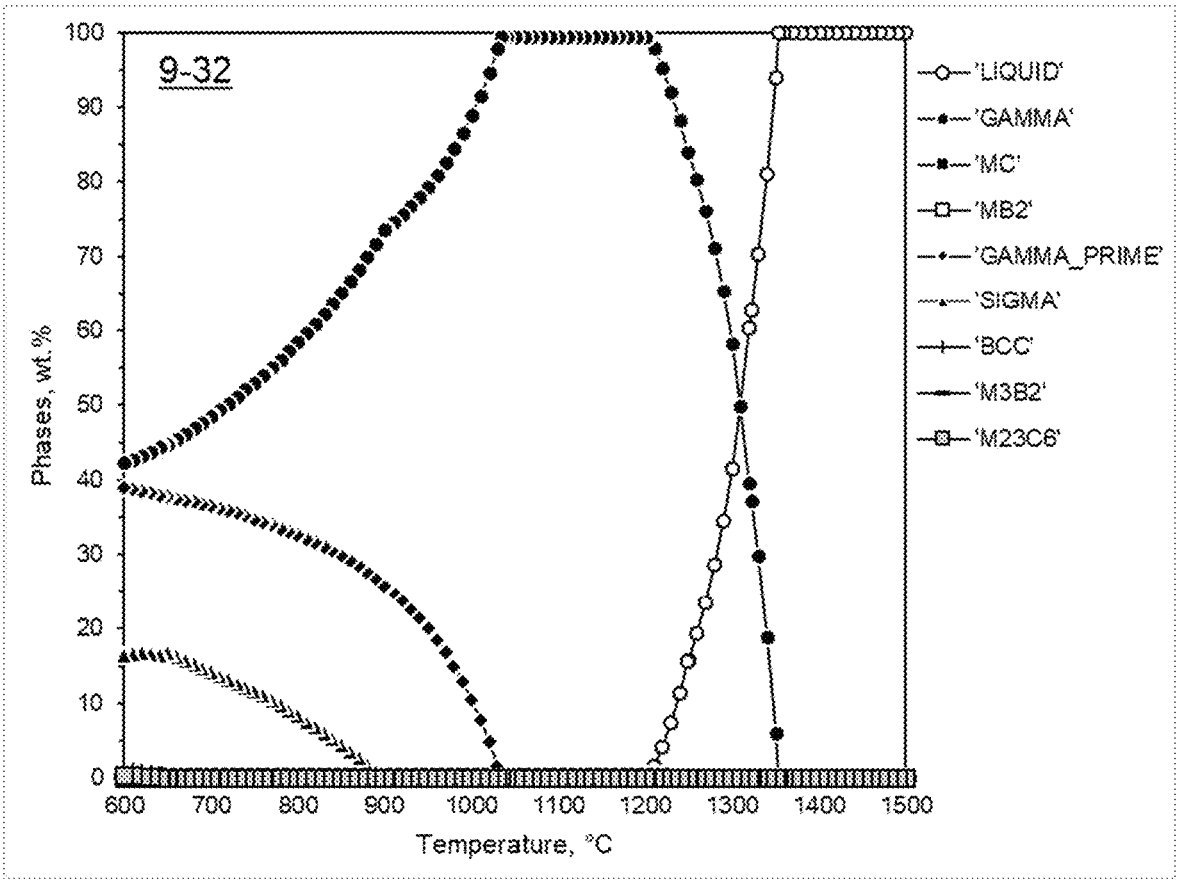
FIG. 32 shows a calculated equilibrium phase diagram for alloy 9-32.
Figure 33:
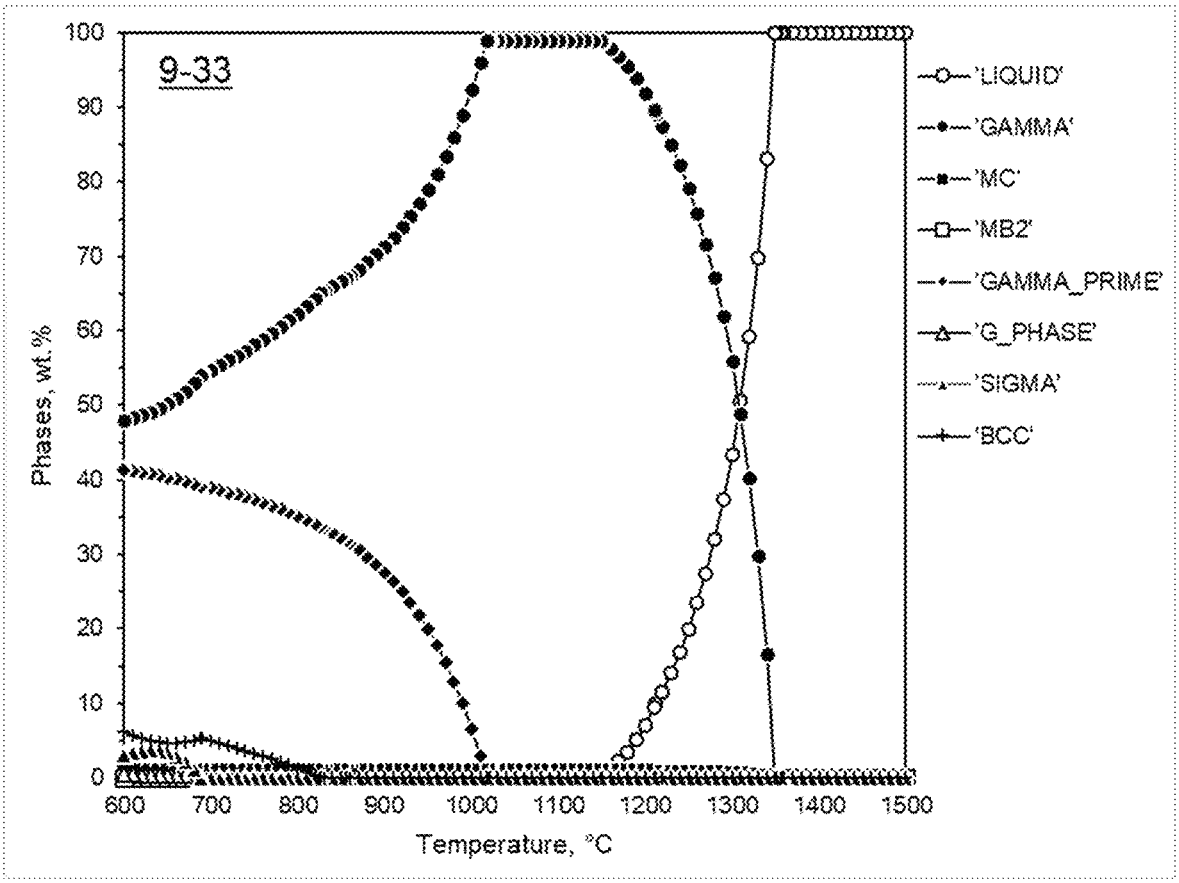
FIG. 33 shows a calculated equilibrium phase diagram for alloy 9-33.
Figure 34:
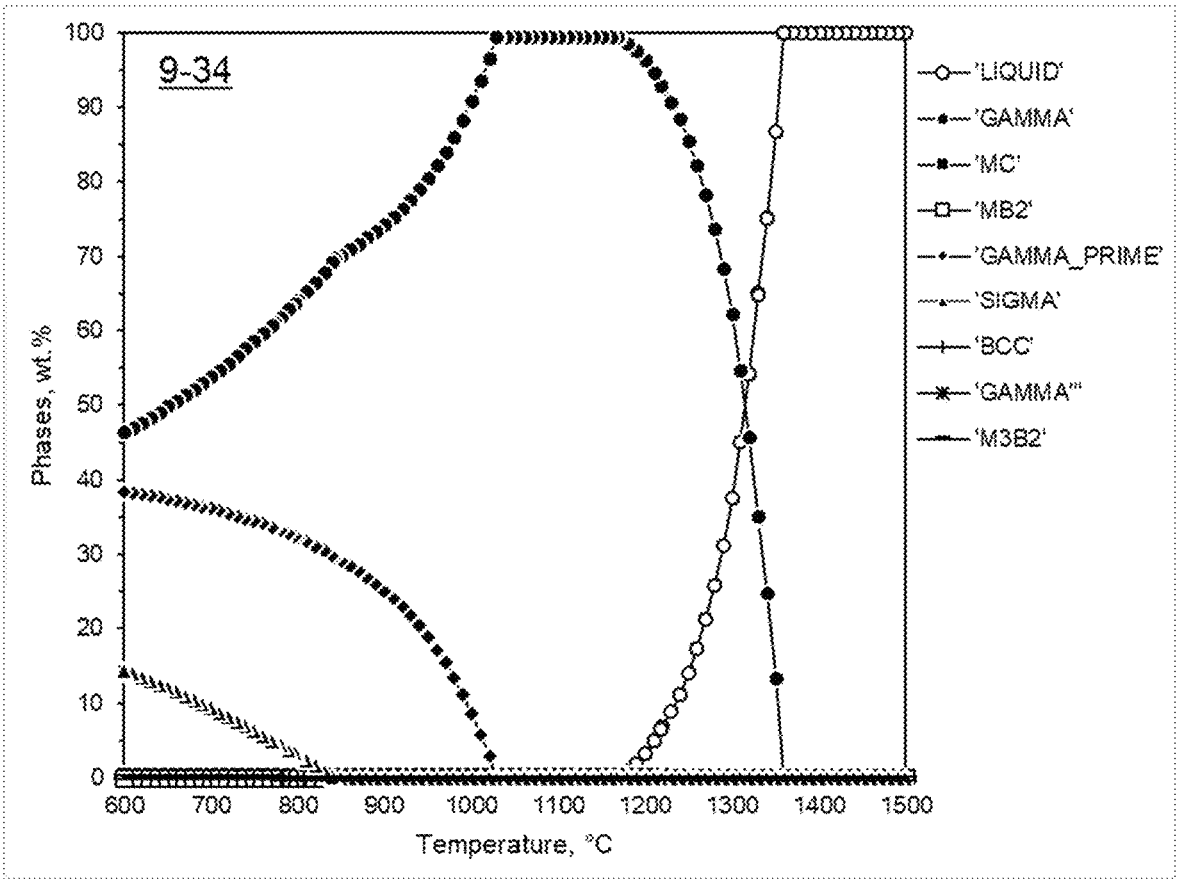
FIG. 34 shows a calculated equilibrium phase diagram for alloy 9-34.
Figure 35:
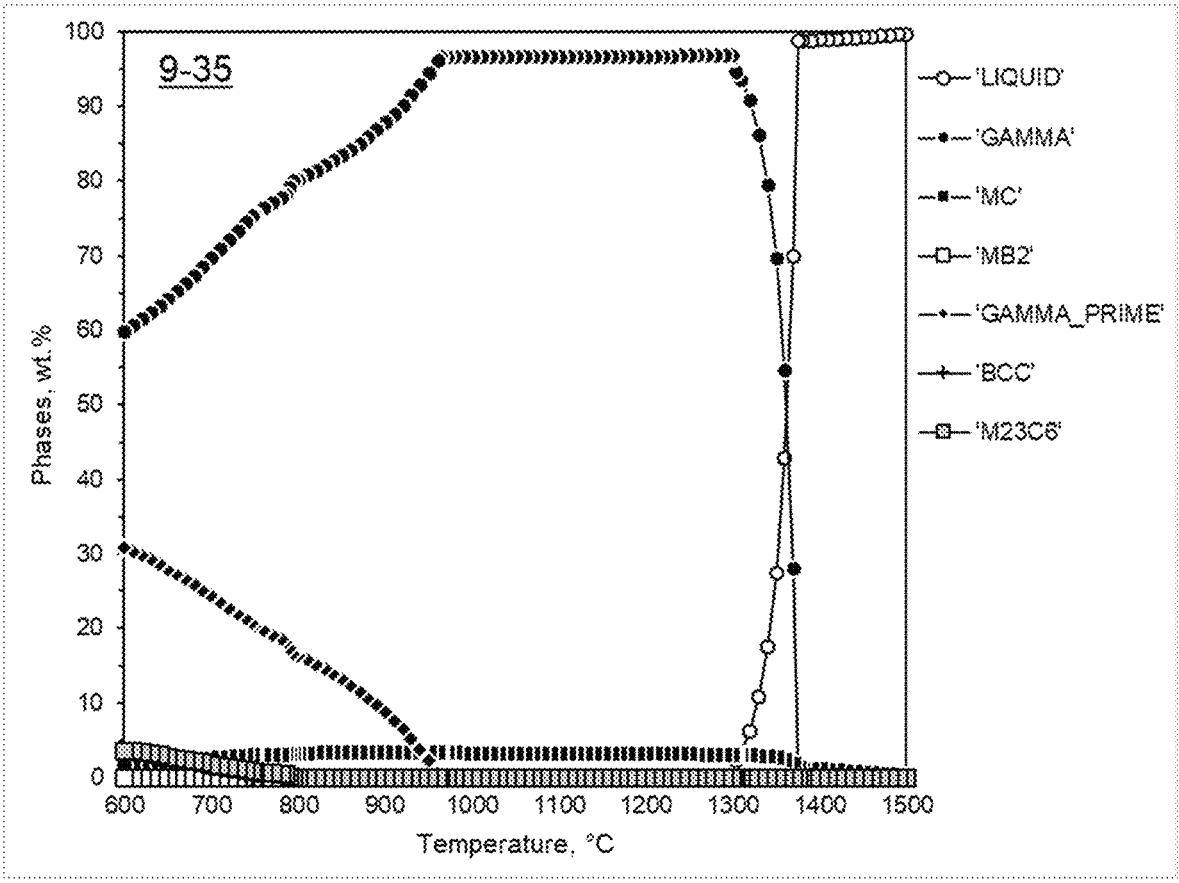
FIG. 35 shows a calculated equilibrium phase diagram for alloy 9-35.
Figure 36:
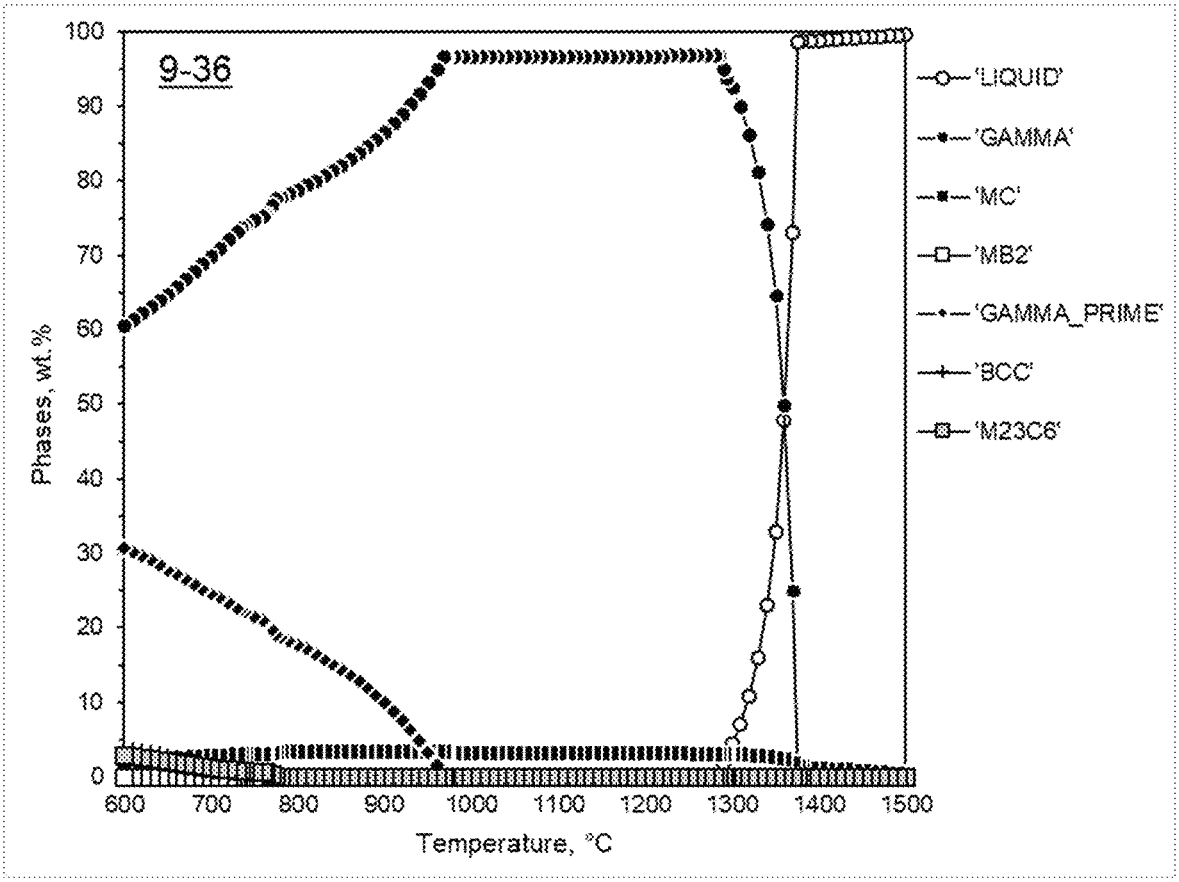
FIG. 36 shows a calculated equilibrium phase diagram for alloy 9-36.
Figure 37:
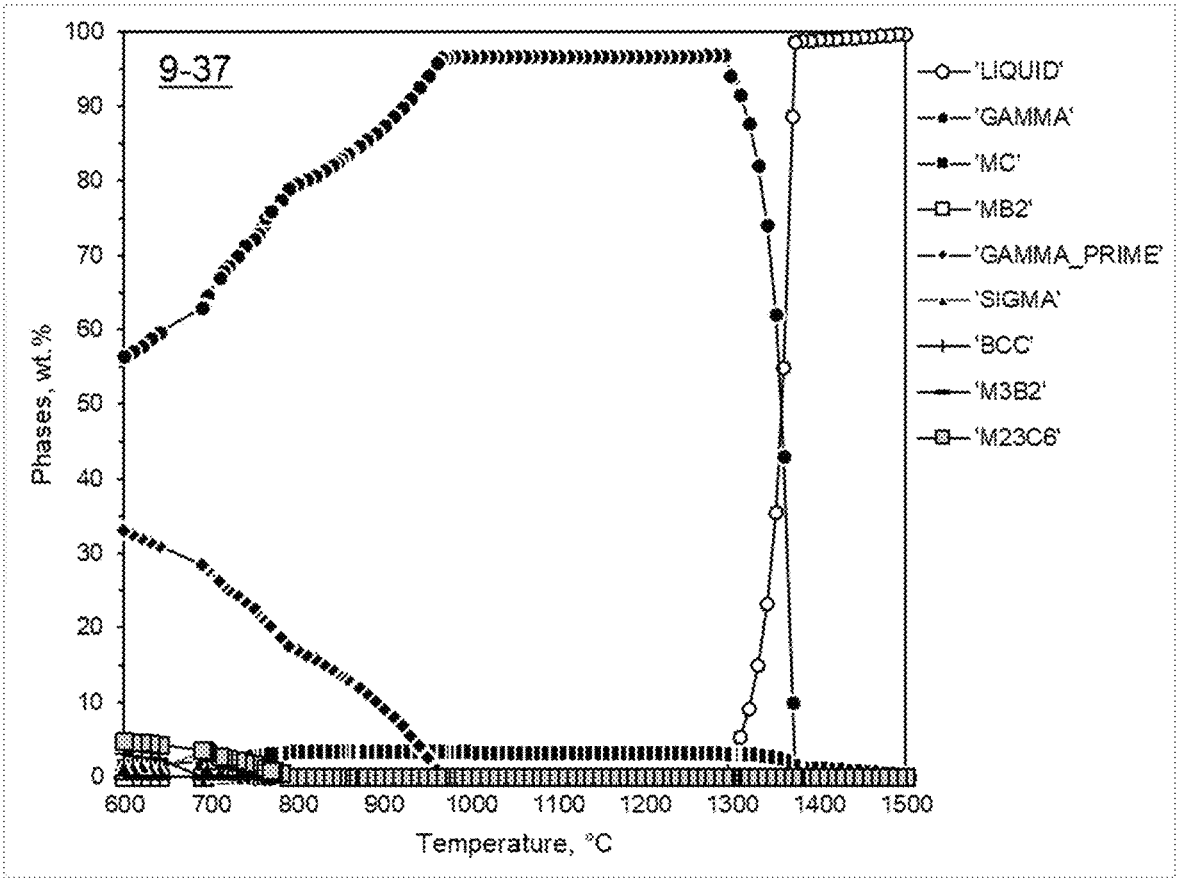
FIG. 37 shows a calculated equilibrium phase diagram for alloy 9-37.

Alumina-forming austenitic (AFA) stainless steels are a class of structural steel alloys which comprise aluminum (Al) at a weight percentage sufficient to form protective aluminum oxide (alumina, $Al_2O_3$) surface layers. The external continuous scale comprising alumina does not form at an Al level below about 2 weight percent. At an Al level higher than about 3 to 5 weight percent, the exact transition dependent on level of austenite stabilizing additions such as Ni (e.g. higher Ni can tolerate more Al), a significant bcc phase is formed in the alloy, which compromises the high temperature properties of the alloy such as creep strength. The external alumina scale is continuous at the alloy/scale interface and though $Al_2O_3$ rich the scale can contain some Mn, Cr, Fe and/or other metal additives such that the growth kinetics of the Al rich oxide scale is within the range of that for known alumina scale.

Nitrogen is found in some conventional $Cr_2O_3$-forming grades of austenitic alloys up to about 0.5 wt. % to enhance the strength of the alloy. The nitrogen levels in AFA alloys must be kept as low as possible to avoid detrimental reaction with the Al and achieve alloys which display oxidation resistance and high creep strength at high temperatures. Although processing will generally result in some uptake of N in the alloy, it is necessary to keep the level of N at less than about 0.06 wt %, or less than 0.03 wt %, for the inventive alloy. When N is present, the Al forms internal nitrides, which can compromise the formation of the alumina scale needed for the desired oxidation resistance as well as a good creep resistance.

The addition of Ti and/or V is common to virtually all high-temperature austenitic stainless steels and related alloys to obtain high temperature creep strength, via precipitation of carbide and related phases. However, the addition of Ti and V shifts the oxidation behavior (possibly by increasing oxygen permeability) in the alloy such that Al is internally oxidized, requiring much higher levels of Al to form an external $Al_2O_3$ scale in the presence of Ti and V. At such high levels, the high temperature strength properties of the resulting alloy are compromised by stabilization of the weak bcc Fe phase. The alloys of this invention are carefully designed to balance oxidation behavior with high temperature strength by using increased Nb, Ni, and/or Cr levels along with Zr, Hf, or Y to offset the detrimental impacts on oxidation of Ti and/or V as is done in the current invention.

Additions of Nb or Ta are necessary for alumina-scale formation. Too much Nb or Ta will negatively affect creep properties by promoting δ-Fe and brittle second phases.

Within the allowable ranges of elements, particularly those of Al, Cr, Ni, Fe, Mn, Mo and, when present Co, W, and Cu, the levels of the elements are adjusted relative to their respective concentrations to achieve a stable fcc austenite phase matrix. The appropriate relative levels of these elements for a composition is readily determined or checked by comparison with commercially available databases or by computational thermodynamic models with the aid of programs such as Thermo-Calc m(Thermo-Calc Software, Solna, Sweden). In the casting of AFA steels, the partitioning of elements during solidification determines composition control. Non-equilibrium phases formed during solidification will modify the type and amount of strengthening phases.

Additionally, up to 3 weight percent Co, up to 3 weight percent Cu, and up to 1 weight percent W can be present in the alloy as desired to enhance specific properties of the alloy. Rare earth and reactive elements, such as Y, La, Ce, Hf, Zr, and the like, at a combined level of up to 1 weight percent can be included in the alloy composition as desired to enhance specific properties of the alloy. Other elements can be present as unavoidable impurities at a combined level of less than 1 weight percent.

The invention provides a new class of alumina-forming austenitic (AFA) Fe-based superalloy, which uses γ'-$Ni_3Al$ phase to achieve creep strength. Coherent precipitates of γ'-$Ni_3Al$ and related phases are well established as the basis for strengthening of Ni-base superalloys, which are among the strongest known classes of heat-resistant alloys. The use of γ'-$Ni_3Al$ in AFA offers the potential for greater creep strengthening and the opportunity to precipitate-harden the AFA alloys for improved high-temperature tensile strength.

Tolerance to nitrogen can be achieved by addition of more nitrogen active alloy additions than Al. Based on thermodynamic assessment, Hf, Ti, and Zr can be used to selectively getter N away from Al. The additions of Hf and Zr generally also offers further benefits for oxidation resistance via the well-known reactive element effect, at levels up to 1 wt. %. Higher levels can result in internal oxidation and degraded oxidation resistance. Studies of AFA alloys have indicated degradation in oxidation resistance of AFA alloys with Ti and, especially, V additions or impurities, and has indicated limiting these additions to no more than 0.3 wt. % total, unless compensated by increased No, Ni, and/or Cr levels along with Zr, Hf, Y additions as is done in the current invention. Assuming stoichiometric TiN formation, with 0.3 wt. % Ti up to around 0.07 wt. % N is possible, which is sufficient to manage and tolerate the N impurities encountered in air casting. A complication is that Ti will also react with C (as will Nb). Therefore, some combination of Hf or Zr and Ti is desirable to manage and tolerate N effectively.

An austenitic Ni-base alloy can comprise, consist essentially of, or consist of, in weight percent:

2.5 to 4.75 Al;
13 to 21 Cr;
20 to 40 Fe;
2.0 to 5.0 total of at least one element selected from the group consisting of Nb and Ta;
0.25 to 4.5 Ti;
0.09 to 1.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.45 C;
0.005 to 0.1 B;
0 to 0.05 P;
less than 0.06 N; and
Ni balance (38 to 47 Ni).

The weight percent Ni is greater than the weight percent Fe. The alloy forms an external continuous scale comprising alumina and has a stable phase FCC austenitic matrix microstructure. The austenitic matrix is essentially delta-ferrite-free, and contains one or more carbides and coherent precipitates of γ' and exhibits a creep rupture lifetime of at least 100 h at 900° C. and 50 MPa. The alloy can include at least one selected from the group consisting of coherent precipitates of γ'-$Ni_3Al$ and carbides.

The $L1_2$ phase at 900° C. can be from 8.72 to 46.77 wt. %. The $L1_2$ phase at 900° C. can be 8.72, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, or 46.77 wt. %. The $L1_2$ phase at 900° C. can be within a range of any high value and low value selected from these values.

The MC phase at 900° C. is from 0.36 to 3.36 wt. %. The MC phase at 900° C. can be 0.36, 0.50, 0.75, 1.0, 1.25, 1.5, 1.75, 2.0, 2.25, 2.5, 2.75, 3.0, 3.25, or 3.36 wt. %. The MC phase at 900° C. can be within a range of any high value and low value selected from these values.

The Sigma+G-phase+BCC-Cr phase at 900° C. is from 0 to 12.96 wt. %. The Sigma+G-phase+BCC-Cr phase at 900° C. can be 0, 0.25, 0.5, 0.75, 1.0, 1.25, 1.5, 1.75, 2.0, 2.25, 2.5, 2.75, 3.0, 3.25, 3.5, 3.75, 4.0, 4.25, 4.5, 4.75, 5.0, 5.25, 5.5, 5.75, 6.0, 6.25, 6.5, 6.75, 7.0, 7.25, 7.5, 7.75, 8.0, 8.25, 8.5, 8.75, 9.0, 9.25, 9.5, 9.75, 10, 10.25, 10.5, 10.75, 11.0, 11.25, 11.5, 11.75, 12.0, 12.25, 12.5, 12.75, or 12.96 wt. %. The Sigma+G-phase+BCC-Cr phase at 900° C. can be within a range of any high value and low value selected from these values.

The $L1_2$+MC−detrimental phases at 900° C. is from 12.07 to 35.93 wt. %. The $L1_2$+MC−detrimental phases at 900° C. can be 12.07, 13, 14, 15, 16, 17, 18, 19, 20, 21, 22, 23, 24, 25, 26, 27, 28, 29, 30, 31, 32, 33, 34, 35 or 35.93 wt. %. The $L1_2$+MC−detrimental phases at 900° C. can be within a range of any high value and low value selected from these values.

The mass change after 2000 h at 900° C. is from −5 to 5 mg/cm$^2$. The mass change after 2000 h at 900° C. can be −5.0, −4.75, −4.55, −4.25, −4.0, −3.75, −3.5, −3.25, −3.0, −2.75, −2.5, −2.25, −2.0, −1.75, −1.5, −1.25, −1.0, −0.75, −0.5, −0.25, 0, 0.25, 0.5, 0.75, 1.0, 1.25, 1.5, 1.75, 2.0, 2.25, 2.5, 2.75, 3.0, 3.25, 3.5, 3.75, 4.0, 4.25, 4.5, or 4.55, 4.75, 5.0 mg/cm$^2$. The mass change after 2000 h at 900° C. can be within a range of any high value and low value selected from these values.

The Ti+Zr atomic ratio is from 0.046 to 0.231. The Ti+Zr atomic ratio can be 0.046, 0.05, 0.06, 0.07, 0.08, 0.09, 0.1, 0.11, 0.12, 0.13, 0.14, 0.15, 0.16, 0.17, 0.18, 0.19, 0.2, 0.21, 0.22, or 0.231. The Ti+Zr atomic ratio can be within a range of any high value and low value selected from these values.

The Al in weight percent can be from 2.5 to 4.75 wt. %. The Al in weight % can be 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7 or 4.75 wt. % Al. The weight % of Al can be within a range of any high value and low value selected from these values.

The Cr in weight percent can be from 13 to 21 wt. %. The Cr in weight % can be 13, 13.5, 14, 14.5, 15, 15.5, 16, 16.5, 17, 17.5, 18, 18.5, 19, 19.5, 20, 20.5, or 21 wt. % Cr. The weight % of Cr can be within a range of any high value and low value selected from these values.

The Fe in weight percent can be from 20 to 40 wt. %. The Fe in weight % can be 20, 21, 22, 23, 24, 25, 26, 27, 28, 29, 30, 31, 32, 33, 34, 35, 36, 37, 38, 39, or 40 wt. % Fe. The weight % of Fe can be within a range of any high value and low value selected from these values.

The Nb+Ta in total weight percent can be from 2 to 5 wt. %. The Nb and Ta in weight % can be 2, 2.2, 2.4, 2.6, 2.8, 3, 3.2, 3.4, 3.6, 3.8, 4, 4.2, 4.4, 4.6, 4.8, 5 wt. % Nb or Ta. The weight % of Nb and/or Ta can be within a range of any high value and low value selected from these values.

The Ti in weight percent can be from 0.25 to 4.5 wt. %. The Ti in weight % can be 0.25, 0.5, 0.75, 1, 1.25, 1.5, 1.75, 2, 2.25, 2.5, 2.75, 3, 3.25, 3.5, 3.75, 4, 4.25, or 4.5 wt. % Ti. The weight % of Ti can be within a range of any high value and low value selected from these values.

The Si in weight percent can be from 0.09 to 1.5 wt. %. The Si in weight % can be 0.09, 0.1, 0.2, 0.3, 0.4, 0.5, 0.6, 0.7, 0.8, 0.9, 1, 1.1, 1.2, 1.3, 1.4, or 1.5 wt. % Si. The weight % of Si can be within a range of any high value and low value selected from these values.

The V in weigh percent can be from 0 to 0.5 wt. %. The V in weight % can be 0, 0.01, 0.02, 0.03, 0.04, 0.05, 0.06, 0.07, 0.08, 0.09, 0.1, 0.11, 0.12, 0.13, 0.14, 0.15, 0.16, 0.17, 0.18, 0.19, 0.2, 0.21, 0.22, 0.23, 0.24, 0.25, 0.26, 0.27, 0.28, 0.29, 0.3, 0.31, 0.32, 0.33, 0.34, 0.35, 0.36, 0.37, 0.38, 0.39, 0.4, 0.41, 0.42, 0.43, 0.44, 0.45, 0.46, 0.47, 0.48, 0.49 or 0.5 wt. % V. The weight % V can be within a range of any high value and low value selected from these values.

The Mn in weight percent can be from 0 to 2 wt. %. The Mn in weight % can be 0, 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9 or 2 wt % Mn. The weight % Mn can be within a range of any high value and low value selected from these values.

The Cu in weight percent can be from 0 to 3 wt. %. The Cu in weight % can be 0, 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9 or 3 wt. % Cu. The weight % Cu can be within a range of any high value and low value selected from these values.

The Mo+W in weight percent can be from 0 to 2 wt. %. The Mo and/or W in weight % can be 0, 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9 or 2 wt. % Mo and/or W. The weight % Mo+W can be within a range of any high value and low value selected from these values.

The Zr+Hf in weight percent can be from 0 to 1 wt. %. The Zr and/or Hf in weight % can be 0, 0.1, 0.12, 0.14, 0.16, 0.18, 0.2, 0.22, 0.24, 0.26, 0.28, 0.3, 0.32, 0.34, 0.36, 0.38, 0.4, 0.42, 0.44, 0.46, 0.48, 0.5, 0.52, 0.54, 0.56, 0.58, 0.6, 0.62, 0.64, 0.66, 0.68, 0.7, 0.72, 0.74, 0.76, 0.78, 0.8, 0.82, 0.84, 0.86, 0.88, 0.9, 0.92, 0.94, 0.96, 0.98 or 1 wt. % Zr and/or Hf. The weight % Zr+Hf can be within a range of any high value and low value selected from these values.

The Y in weight percent can be from 0 to 0.15 wt. %. The Y in weight % can be 0, 0.01, 0.02, 0.03, 0.04, 0.05, 0.06, 0.07, 0.08, 0.09, 0.1, 0.11, 0.12, 0.13, 0.14 or 0.15 Y %. The weight % Y can be within a range of any high value and low value selected from these values.

The C in weight percent can be from 0.01 to 0.45 wt. %. C in weight % can be 0.01, 0.02, 0.03, 0.04, 0.05, 0.06, 0.07, 0.08, 0.09, 0.1, 0.125, 0.15, 0.175, 0.2, 0.225, 0.25. 0.275, 0.3, 0.325, 0.35, 0.375, 0.4, 0.425, 0.45 wt. % C. The weight % of C can be within a range of any high value and low value selected from these values.

The B in weight percent can be from 0.005 to 0.1 wt. %. The B in weight % can be 0.005, 0.006, 0.007, 0.008, 0.009, 0.01, 0.02, 0.03, 0.04, 0.05, 0.06, 0.07, 0.08, 0.09 or 0.1 wt. % B. The weight % B can be within a range of any high value and low value selected from these values.

The P in weight percent can be from 0 to 0.05 wt. %. The P in weight % can be 0, 0.005, 0.006, 0.007, 0.008, 0.009, 0.01, 0.011, 0.012, 0.013, 0.014, 0.015, 0.016, 0.017, 0.018, 0.019, 0.02, 0.021, 0.022, 0.023, 0.024, 0.025, 0.026, 0.027, 0.028, 0.029, 0.03, 0.031, 0.032, 0.033, 0.034, 0.035, 0.036, 0.037, 0.038, 0.039, 0.04, 0.041, 0.042, 0.043, 0.044, 0.045, 0.046, 0.047, 0.048, 0.049 or 0.05 wt. % P. The weight % P can be within a range of any high value and low value selected from these values.

The N in weight percent can be from 0 to less than 0.06 wt. %. The N in weight % can be 0, 0.002, 0.004, 0.006, 0.008, 0.01, 0.012, 0.014, 0.016, 0.018, 0.02, 0.022, 0.024, 0.026, 0.028, 0.03, 0.032, 0.034, 0.036, 0.038, 0.04, 0.042, 0.044, 0.046, 0.048, 0.05, 0.052, 0.054, 0.056, 0.058 or 0.059 wt. % N. The weight % N can be within a range of any high value and low value selected from these values.

The Ni in weight percent can be from 38 to 47 wt. %. The Ni in weight % can be 38, 38.5, 39, 39.5, 40, 40.5, 41, 41.5, 42, 42.5, 43, 43.5, 44, 44.5, 45, 45.5, 46, 46.5, or 47 wt. % Ni. The weight % Ni can be within a range of any high value and low value selected from these values.

Reference alloys 9-1 to 9-9 and invention alloys 9-10 to 9-37 were prepared. The compositions of these alloys are reported in Table 3:

TABLE 3

Analyzed alloy compositions of the reference and invention alloys

| Alloy ID | Composition, wt % | | | | | | | | | | | | | |
|---|---|---|---|---|---|---|---|---|---|---|---|---|---|---|
| | Ni | Al | Cr | Fe | Hf | Mo | Nb | Si | Ti | W | Y | Zr | B | C |
| Reference alloys (<35.5 wt. % Ni) | | | | | | | | | | | | | | |
| Alloy 9-1 | 34.99 | 3.52 | 14.74 | 41.03 | | | 3.10 | 0.15 | 2.05 | | | 0.31 | 0.008 | 0.100 |
| Alloy 9-2 | 35.01 | 3.48 | 14.66 | 41.16 | | | 3.11 | 0.16 | 2.04 | | | 0.31 | 0.009 | 0.060 |
| Alloy 9-3 | 35 | 3.99 | 13.70 | 41.50 | | | 2.02 | 0.16 | 3.56 | | | | 0.008 | 0.060 |
| Alloy 9-4 | 35.03 | 3.55 | 14.63 | 41.04 | 0.16 | | 3.01 | 0.14 | 2.01 | | 0.03 | 0.28 | 0.006 | 0.110 |
| Alloy 9-5 | 35.03 | 3.55 | 14.68 | 41.08 | | | 3.04 | 0.16 | 2.02 | | 0.03 | 0.29 | 0.006 | 0.110 |
| Alloy 9-6 | 34.99 | 3.52 | 14.64 | 41.07 | 0.16 | | 3.00 | 0.15 | 2.01 | | 0.11 | 0.29 | 0.006 | 0.060 |
| Alloy 9-7 | 34.93 | 3.55 | 14.57 | 41.37 | | | 3.02 | 0.15 | 2.02 | | 0.04 | 0.29 | 0.007 | 0.060 |
| Alloy 9-8 | 35.06 | 4.06 | 13.64 | 41.26 | 0.16 | | 2.01 | 0.14 | 3.59 | | 0.02 | | 0.007 | 0.060 |
| Alloy 9-9 | 35.05 | 4.02 | 13.64 | 41.56 | | | 1.97 | 0.15 | 3.53 | | 0.02 | | 0.007 | 0.060 |
| Invention alloys (>39.5 wt. % Ni) | | | | | | | | | | | | | | |
| Alloy 9-10 | 40.35 | 3.59 | 14.26 | 34.71 | | | 3.93 | 0.18 | 2.46 | | | 0.47 | 0.011 | 0.040 |
| Alloy 9-11 | 40.11 | 3.26 | 20.08 | 31.17 | 0.12 | | 3.03 | 0.15 | 1.93 | | 0.03 | | 0.007 | 0.110 |
| Alloy 9-12 | 40.06 | 3.28 | 18.21 | 33.14 | 0.12 | | 2.98 | 0.16 | 1.90 | | 0.03 | | 0.006 | 0.110 |
| Alloy 9-13 | 44.37 | 4.01 | 20.03 | 25.10 | 0.17 | | 2.31 | 0.77 | 3.07 | | 0.07 | 0.00 | 0.013 | 0.090 |
| Alloy 9-14 | 39.8 | 4.01 | 13.89 | 35.86 | | | 2.02 | 0.14 | 4.22 | | | | 0.007 | 0.060 |
| Alloy 9-15 | 44.46 | 3.26 | 20.26 | 27.53 | | | 3.01 | 0.17 | 0.85 | | 0.04 | 0.30 | 0.009 | 0.110 |
| Alloy 9-16 | 46.25 | 3.30 | 17.86 | 27.21 | | | 2.96 | 0.13 | 1.96 | | 0.06 | 0.11 | 0.010 | 0.110 |
| Alloy 9-17 | 44.23 | 3.99 | 20.09 | 24.57 | 0.15 | 0.54 | 2.26 | 0.16 | 3.04 | 0.55 | 0.06 | 0.30 | 0.010 | 0.050 |
| Alloy 9-18 | 43.82 | 3.46 | 18.45 | 29.50 | | | 3.19 | 0.13 | 0.89 | | 0.10 | 0.33 | 0.010 | 0.120 |
| Alloy 9-19 | 44.35 | 3.55 | 18.42 | 28.08 | | 0.53 | 3.04 | 0.12 | 0.98 | 0.61 | 0.08 | 0.10 | 0.012 | 0.100 |
| Alloy 9-20 | 44.31 | 3.81 | 16.79 | 24.07 | 0.16 | 0.61 | 4.63 | 0.24 | 4.20 | 0.36 | 0.06 | 0.68 | 0.005 | 0.080 |
| Alloy 9-21 | 39.97 | 3.49 | 14.77 | 36.04 | | | 3.10 | 0.15 | 2.05 | | | 0.31 | 0.008 | 0.110 |
| Alloy 9-22 | 44.49 | 3.57 | 20.14 | 24.31 | 0.12 | 0.36 | 3.18 | 0.10 | 2.98 | 0.36 | 0.06 | 0.21 | 0.009 | 0.110 |
| Alloy 9-23 | 44.3 | 3.54 | 18.49 | 28.67 | | | 3.05 | 0.11 | 1.50 | | 0.08 | 0.11 | 0.013 | 0.110 |
| Alloy 9-24 | 44.26 | 3.60 | 20.18 | 26.00 | 0.12 | | 3.19 | 0.15 | 2.02 | | 0.06 | 0.31 | 0.005 | 0.110 |
| Alloy 9-25 | 45.16 | 3.33 | 15.19 | 31.02 | | | 2.95 | 0.11 | 1.97 | | 0.05 | 0.11 | 0.007 | 0.110 |
| Alloy 9-26 | 45.21 | 3.52 | 15.80 | 30.14 | | | 2.97 | 0.12 | 1.98 | | 0.05 | 0.10 | 0.005 | 0.110 |
| Alloy 9-27 | 44.82 | 3.53 | 18.30 | 28.88 | | | 3.05 | 0.12 | 0.98 | | 0.06 | 0.11 | 0.012 | 0.110 |
| Alloy 9-28 | 44.54 | 3.77 | 19.51 | 23.35 | 0.17 | 0.56 | 4.15 | 0.19 | 2.58 | 0.36 | 0.07 | 0.63 | 0.005 | 0.120 |
| Alloy 9-29 | 44.73 | 3.55 | 18.07 | 27.48 | 0.13 | | 3.25 | 0.16 | 2.11 | | 0.05 | 0.36 | 0.005 | 0.110 |
| Alloy 9-30 | 43.99 | 3.34 | 18.07 | 25.93 | 0.21 | 0.64 | 4.04 | 0.18 | 2.50 | 0.40 | 0.11 | 0.48 | 0.005 | 0.110 |
| Alloy 9-31 | 45.12 | 3.60 | 16.50 | 28.43 | | | 3.56 | 0.13 | 2.29 | | 0.07 | 0.14 | 0.018 | 0.110 |
| Alloy 9-32 | 44.82 | 3.02 | 16.78 | 28.79 | | 0.48 | 2.05 | 0.13 | 3.10 | 0.54 | 0.06 | 0.10 | 0.023 | 0.060 |
| Alloy 9-33 | 45.42 | 3.59 | 14.35 | 29.92 | | | 3.66 | 0.17 | 2.36 | | | 0.41 | 0.010 | 0.110 |
| Alloy 9-34 | 44.99 | 3.00 | 14.64 | 30.72 | | 0.49 | 2.04 | 0.16 | 3.07 | 0.52 | | 0.30 | 0.008 | 0.060 |
| Alloy 9-35 | 44.94 | 3.38 | 15.92 | 29.21 | | 0.48 | 2.94 | 0.11 | 1.97 | 0.48 | 0.05 | 0.11 | 0.007 | 0.410 |
| Alloy 9-36 | 45.12 | 3.48 | 15.09 | 30.55 | | | 2.92 | 0.09 | 1.98 | | 0.04 | 0.33 | 0.007 | 0.400 |
| Alloy 9-37 | 45.33 | 3.43 | 15.80 | 29.86 | | | 2.93 | 0.11 | 1.96 | | 0.05 | 0.11 | 0.006 | 0.410 |

The creep rupture-life at 900° C. and 50 MPa, calculated amounts of the second-phases at 900° C., the mass changes after oxidation testing, and the Ti+Zr atomic fraction of the reference alloys 9-1 to 9-9 and invention alloys 9-10 to 9-37 are presented in Table 4:

TABLE 4

Creep rupture-life at 900° C. and 50 MPa, calculated amounts of the second-phases at 900° C., the mass changes after oxidation testing, and the Ti + Zr atomic fraction

| Alloy ID | Rupture life, h (900° C., 50 Mpa) | Calculated phases (900° C.), wt.% | | | | Mass change, mg/cm$^2$ (2 kh at 900° C.) | Ti + Zr atomic ratio* |
|---|---|---|---|---|---|---|---|
| | | $L1_2$ | MC | Sigma + G-phase + BCC-Cr | $L1_2$ + MC-detrimental phases | | |
| Reference Alloys (<35.5 wt. % Ni) | | | | | | | |
| Alloy 9-1 | 20.7 | 7.67 | 0.94 | 0.00 | 8.61 | −7.60 | 0.124 |
| Alloy 9-2 | 12.8 | 7.52 | 0.54 | 0.00 | 8.06 | −11.22 | 0.126 |
| Alloy 9-3 | 27.4 | 12.22 | 0.48 | 0.00 | 12.69 | 0.68 | 0.204 |
| Alloy 9-4 | 9.6 | 7.63 | 1.12 | 0.00 | 8.75 | 3.18 | 0.122 |
| Alloy 9-5 | 9.3 | 7.49 | 1.04 | 0.00 | 8.53 | 2.51 | 0.123 |

TABLE 4-continued

Creep rupture-life at 900° C. and 50 MPa, calculated amounts of the second-phases at 900° C., the mass changes after oxidation testing, and the Ti + Zr atomic fraction

| Alloy ID | Rupture life, h (900° C., 50 Mpa) | Calculated phases (900° C.), wt.% $L1_2$ | MC | Sigma + G-phase + BCC-Cr | $L1_2$ + MC-detrimental phases | Mass change, $mg/cm^2$ (2 kh at 900° C.) | Ti + Zr atomic ratio* |
|---|---|---|---|---|---|---|---|
| Alloy 9-6 | 7.5 | 7.61 | 0.62 | 0.00 | 8.23 | 2.94 | 0.123 |
| Alloy 9-7 | 10.2 | 7.10 | 0.55 | 0.00 | 7.65 | 1.31 | 0.125 |
| Alloy 9-8 | 22.9 | 12.26 | 0.58 | 0.00 | 12.84 | 2.00 | 0.205 |
| Alloy 9-9 | 13.5 | 12.13 | 0.48 | 0.00 | 12.61 | 1.35 | 0.203 |
| Invention Alloys (>39.5 wt. % Ni) | | | | | | | |
| Alloy 9-10 | 99.7 | 21.34 | 0.36 | 0.05 | 21.65 | −3.60 | 0.150 |
| Alloy 9-11 | 130.1 | 19.54 | 1.11 | 5.00 | 15.64 | 0.38 | 0.086 |
| Alloy 9-12 | 143.4 | 17.55 | 1.11 | 0.70 | 17.97 | 0.43 | 0.092 |
| Alloy 9-13 | 179.9 | 27.05 | 0.82 | 12.96 | 14.91 | 0.62 | 0.133 |
| Alloy 9-14 | 219.7 | 29.01 | 0.47 | 0.00 | 29.48 | 1.00 | 0.231 |
| Alloy 9-15 | 228.0 | 13.08 | 1.07 | 0.67 | 13.48 | 0.69 | 0.046 |
| Alloy 9-16 | 260.6 | 21.52 | 1.03 | 0.00 | 22.55 | 0.40 | 0.099 |
| Alloy 9-17 | 284.8 | 35.29 | 0.52 | 11.92 | 23.89 | 4.55 | 0.138 |
| Alloy 9-18 | 294.3 | 13.12 | 1.17 | 0.00 | 14.29 | 0.68 | 0.053 |
| Alloy 9-19 | 357.2 | 14.28 | 0.98 | 0.00 | 15.26 | 0.57 | 0.052 |
| Alloy 9-20 | 373.2 | 46.77 | 0.81 | 11.65 | 35.93 | 1.61 | 0.200 |
| Alloy 9-21 | 382.7 | 17.18 | 1.06 | 0.00 | 18.24 | −4.55 | 0.124 |
| Alloy 9-22 | 396.7 | 34.20 | 1.07 | 10.31 | 24.96 | 3.96 | 0.130 |
| Alloy 9-23 | 400.7 | 18.13 | 1.06 | 0.01 | 19.17 | 0.55 | 0.075 |
| Alloy 9-24 | 406.4 | 26.64 | 1.10 | 6.60 | 21.14 | 2.08 | 0.095 |
| Alloy 9-25 | 436.5 | 19.23 | 1.03 | 0.00 | 20.26 | 0.58 | 0.113 |
| Alloy 9-26 | 442.3 | 20.62 | 1.03 | 0.00 | 21.65 | 0.61 | 0.109 |
| Alloy 9-27 | 509.6 | 13.48 | 1.07 | 0.00 | 14.55 | 0.45 | 0.052 |
| Alloy 9-28 | 514.8 | 38.48 | 1.21 | 12.69 | 27.00 | 2.78 | 0.123 |
| Alloy 9-29 | 534.7 | 26.24 | 1.10 | 2.54 | 24.80 | −1.89 | 0.109 |
| Alloy 9-30 | 628.2 | 32.86 | 1.14 | 8.68 | 25.31 | −0.64 | 0.125 |
| Alloy 9-31 | 772.7 | 26.69 | 1.05 | 0.00 | 27.74 | 0.42 | 0.119 |
| Alloy 9-32 | 1000.0 | 25.75 | 0.53 | 0.08 | 26.20 | 2.51 | 0.158 |
| Alloy 9-33 | 1872.5 | 27.56 | 1.05 | 0.00 | 28.61 | −3.91 | 0.142 |
| Alloy 9-34 | 2446.5 | 25.10 | 0.56 | 0.00 | 25.66 | 1.04 | 0.179 |
| Alloy 9-35 | 158.0 | 8.72 | 3.35 | 0.00 | 12.07 | 1.00 | 0.102 |
| Alloy 9-36 | 163.4 | 9.94 | 3.36 | 0.00 | 13.30 | 0.89 | 0.112 |
| Alloy 9-37 | 178.2 | 9.10 | 3.36 | 0.00 | 12.46 | 0.96 | 0.102 |

*T + Zr atomic ratio = (Ti/47.867 + Zr/91.224)/(Ti/47.867 + Zr/91.224 + Nb/92.906 + Hf/178.49 + Y/88.906 + C/12.011 + Cr/51.966), where each element needs to input mass percent.

Figure 38:
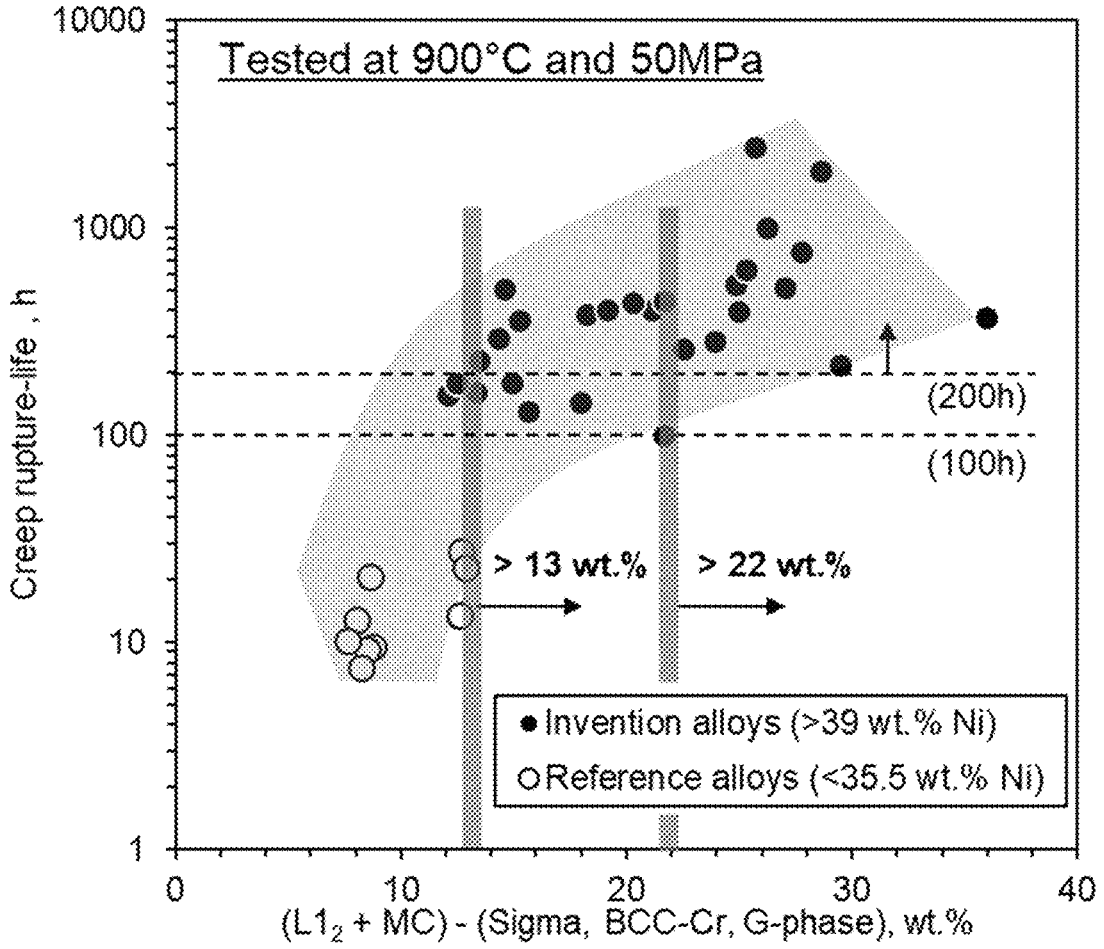
FIG. 38 shows the creep-rupture life of the alloys tested at 900° C. and 50 MPa, plotted as a function of the differential amounts between the strengthening phase and the detrimental phases.

FIGS. 1-37 show calculated equilibrium phase diagrams for alloys 9-1 to 9-37, respectively. FIG. 38 presents the creep-rupture lives of the alloys tested at 900° C. and 50 MPa, plotted as a function of the differential amounts between the strengthening phase and the detrimental phases. FIG. 38 represents experimentally obtained creep-rupture lives of the reference and invention alloys tested at 900° C. and 50 MPa, plotted as a function of the differential amounts between the strengthening "$L1_2$ phase and MC carbides" and the detrimental phases including Sigma, BCC-Cr, and G-phase. The amounts of phases were calculated by a thermodynamic software (JMatPro v.9—Sente Software, Surrey Research Park, United Kingdom) with the chemical compositions listed in Table 3. The creep-rupture life monotonically increases with the differential amounts of the phases. It requires more than 13 wt. % of the differential amounts to reach the target above 100 h creep rupture-life at 900° C. and 50 MPa and more than 25.0 wt, % and less than 29.0 wt. % to reach the target above 500 h creep rupture-life at 900° C. and 50 MPa. Although Ni contents also provide a clear difference in creep rupture-lives between the reference alloys with <35.5 wt. % Ni and the invention alloys with >39.5 wt. % Ni. FIG. 38 indicates that the balance of the strengthening phase ($L1_2$ in the present case) and the detrimental phases provided a major contribution in improving creep performance. Therefore, the invention provides the calculated phases for achieving the requirement creep rupture-life.

Table 5 represents the mass changes of the reference and invention alloys exposed in air+10% water vapor environment with 500 h-cycles as a function of cycles for a total of 2000 hours.

TABLE 5

Mass changes of the reference and invention alloys exposed in air + 10% water vapor environment with 500 h-cycles as a function of cycles for a total of 2000 hours.

| Alloy ID | 500 h | 1000 h | 1500 h | 2000 h |
|---|---|---|---|---|
| Reference Alloys (<35.5 wt. % Ni) | | | | |
| 45Ni—35Cr | −5.814 | −6.489 | −10.434 | −12.728 |
| Alloy 9-1 | 2.110 | 2.480 | −2.180 | −7.600 |
| Alloy 9-2 | 2.190 | 2.400 | −5.480 | −11.220 |
| Alloy 9-3 | 0.390 | 0.510 | 0.630 | 0.680 |
| Alloy 9-4 | 1.810 | 2.620 | 3.030 | 3.180 |
| Alloy 9-5 | 1.690 | 2.460 | 2.720 | 2.510 |
| Alloy 9-6 | 1.510 | 2.130 | 2.540 | 2.940 |

TABLE 5-continued

Mass changes of the reference and invention alloys exposed in air + 10% water vapor environment with 500 h-cycles as a function of cycles for a total of 2000 hours.

| Alloy ID | 500 h | 1000 h | 1500 h | 2000 h |
|---|---|---|---|---|
| Alloy 9-7 | 1.680 | 2.470 | 2.310 | 1.310 |
| Alloy 9-8 | 1.660 | 2.190 | 2.320 | 2.000 |
| Alloy 9-9 | 0.880 | 1.190 | 1.360 | 1.350 |
| Invention Alloys (>39.5 wt. % Ni) | | | | |
| Alloy 9-10 | 1.670 | 2.300 | −0.340 | −3.600 |
| Alloy 9-11 | 0.250 | 0.330 | 0.350 | 0.380 |
| Alloy 9-12 | 0.270 | 0.350 | 0.390 | 0.430 |
| Alloy 9-13 | 0.480 | 0.559 | 0.639 | 0.620 |
| Alloy 9-14 | 0.580 | 0.790 | 0.970 | 1.000 |
| Alloy 9-15 | 0.440 | 0.580 | 0.630 | 0.690 |
| Alloy 9-16 | 0.616 | 0.424 | 0.376 | 0.396 |
| Alloy 9-17 | 2.210 | 3.077 | 3.840 | 4.550 |
| Alloy 9-18 | 0.470 | 0.600 | 0.620 | 0.680 |
| Alloy 9-19 | 0.360 | 0.451 | 0.513 | 0.565 |
| Alloy 9-20 | 1.502 | 2.205 | 2.287 | 1.610 |
| Alloy 9-21 | 2.000 | 2.540 | −1.700 | −4.550 |
| Alloy 9-22 | 1.690 | 2.708 | 3.320 | 3.960 |
| Alloy 9-23 | 0.433 | 0.482 | 0.512 | 0.554 |
| Alloy 9-24 | 1.570 | 2.157 | 2.431 | 2.080 |
| Alloy 9-25 | 0.419 | 0.401 | 0.475 | 0.578 |
| Alloy 9-26 | 0.463 | 0.445 | 0.518 | 0.612 |
| Alloy 9-27 | 0.360 | 0.434 | 0.434 | 0.450 |
| Alloy 9-28 | 1.398 | 2.615 | 3.062 | 2.780 |
| Alloy 9-29 | 1.932 | 2.433 | 1.985 | −1.890 |
| Alloy 9-30 | 1.490 | 1.814 | 1.370 | −0.640 |
| Alloy 9-31 | 0.640 | 0.619 | 0.471 | 0.416 |
| Alloy 9-32 | 1.840 | 2.268 | 2.480 | 2.511 |
| Alloy 9-33 | 1.600 | 2.240 | −0.290 | −3.910 |
| Alloy 9-34 | 2.010 | 2.700 | 3.172 | 1.043 |
| Alloy 9-35 | 0.575 | 0.575 | 0.780 | 0.965 |
| Alloy 9-36 | 1.558 | 1.450 | 1.355 | 0.891 |
| Alloy 9-37 | 0.590 | 0.590 | 0.853 | 0.996 |

Figure 39:
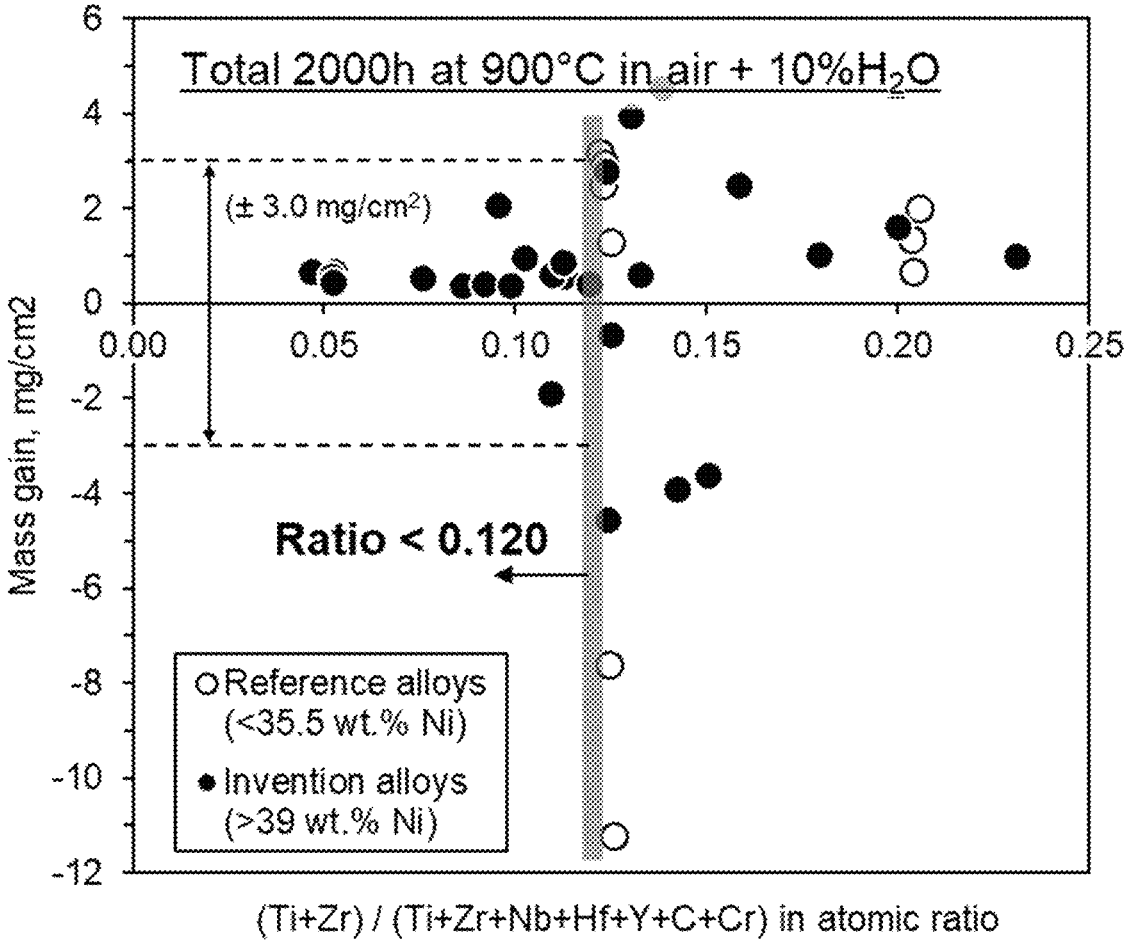
FIG. 39 shows the mass change ($mg/cm^2$) in the reference and invention alloys exposed in air+10% water vapor environment with 500 h-cycles, plotted as a function of Ti+Zr atomic fraction (Eq. 1) for 2,000 h at 900° C.

FIG. 39 is a representation of the mass changes in the reference and invention alloys exposed in air+10% water vapor environment with 500 h-cycles, plotted as a function of Ti+Zr atomic fraction (Eq. 1) for 2,000 h at 900° C.

The oxidation resistances can be quantified by the mass changes of the alloys after exposure in oxidizing environments. The smaller mass changes the better oxidation resistance. FIGS. 39 illustrates the mass changes of the alloys after exposure in air+10% water vapor at 900° C. for total 2000 h plotted as a function of Ti+Zr atomic fraction relative to the total amount of the reactive elements (Ti, Zr, Nb, Hf, and Y), C, and Cr, represented in Eq. 1.

$$\text{Ti}+\text{Zr atomic fraction} = \left(\frac{\text{Ti}}{47.867}+\frac{\text{Zr}}{91.224}\right)\Big/\left(\frac{\text{Ti}}{47.867}+\frac{\text{Zr}}{91.224}+\frac{\text{Nb}}{92.906}+\frac{\text{Hf}}{178.49}+\frac{\text{Y}}{88.906}+\frac{\text{C}}{12.011}+\frac{\text{Cr}}{51.966}\right), \quad \text{[Eq. 1]}$$

where the mass percent of each element needs to be input for calculation.

Excess amounts of Ti and Zr are known to deteriorate the oxidation resistance at elevated temperatures. The mass changes vs. Ti+Zr atomic fraction displays a clear boundary showing the upper limit of the atomic fraction to avoid the significant mass gain or mass loss (equivalent to the loss of oxidation resistance); the fraction should be below 0.120 for 900° C. exposure. Note that the tested environment is very aggressive condition compared to industrial steam environments, so that the limited mass changes in the tested conditions indicate high oxidation resistance.

Figure 40:
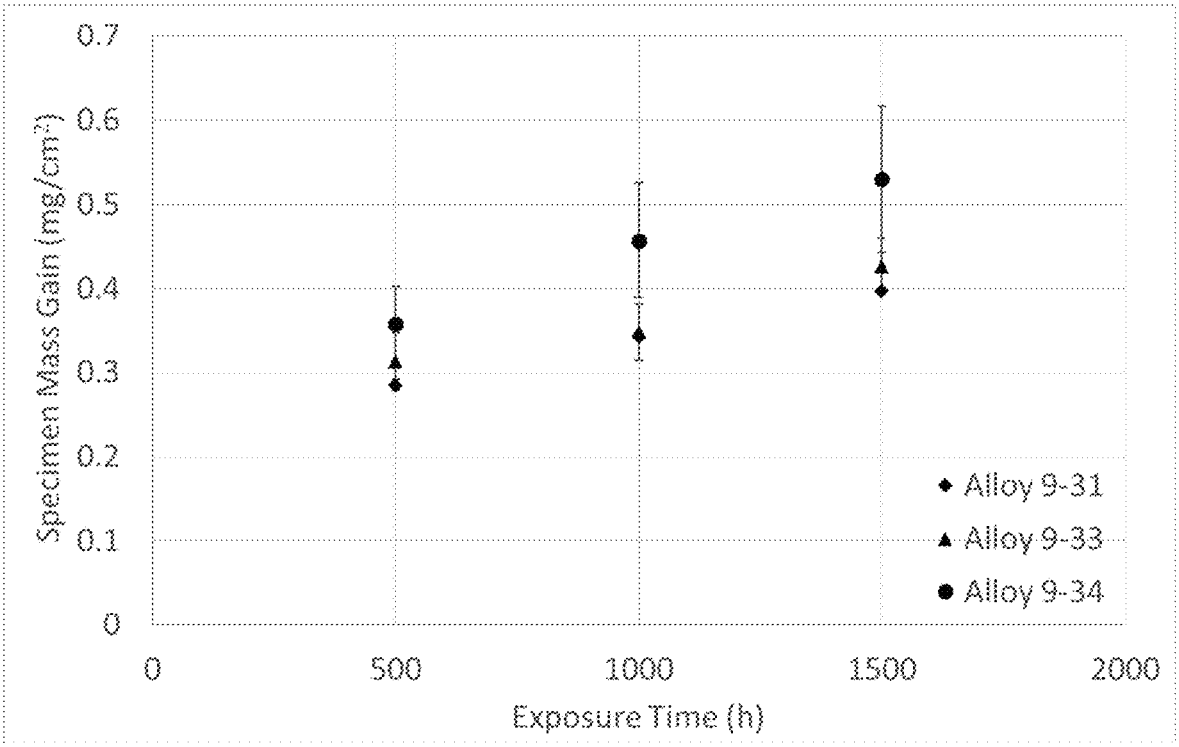
FIG. 40 shows the mass gain after the 500, 1000, and 1500 hour exposure to $sCO_2$750° C. and 300 bar obtained from 500 hour exposure cycles.

FIG. 40 shows the mass gain after the 500, 1000, and 1500 hour exposure to $sCO_2$ 750° C. and 300 bar obtained from 500 hour exposure cycles with lower mass gain indicating better performance of the alloy. Note the better performance of Alloys 9-31 and Alloy 9-33 compared to Alloy 9-34.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. An austenitic Ni-base alloy, comprising, in weight percent:

2.5 to 4.75 Al;
13 to 21 Cr;
20 to 40 Fe;
2.0 to 5.0 total of at least one element selected from the group consisting of Nb and Ta;
0.25 to 4.5 Ti;
0.09 to 1.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.45 C;
0.005 to 0.1 B;
0 to 0.05 P;
less than 0.06 N; and
Ni balance (38 to 47 Ni);
wherein the weight percent Ni is greater than the weight percent Fe, wherein said alloy forms an external continuous scale comprising alumina and has a stable phase FCC austenitic matrix microstructure, said austenitic matrix being essentially delta-ferrite-free, and contains one or more carbides and coherent precipitates of γ' and exhibits a creep rupture lifetime of at least 100 h at 900° C. and 50 MPa.

2. The alloy of claim 1, wherein the alloy comprises at least one selected from the group consisting of coherent precipitates of y'-$Ni_3Al$ and carbides.

3. The alloy of claim 1, wherein the $L1_2$ phase at 900° C. is from 8.72 to 46.77 wt. %.

4. The alloy of claim 1, wherein the MC phase at 900° C. is from 0.36 to 3.36 wt. %.

5. The alloy of claim 1, wherein the Sigma+G-phase+BCC-Cr phase at 900° C. is from 0 to 12.96 wt. %.

6. The alloy of claim 1, wherein the $L1_2$+MC−detrimental phases at 900° C. is from 13 to 36 wt. %.

7. The alloy of claim 1, wherein the $L1_2$+MC−detrimental phases at 900° C. is from 22 to 36 wt. %.

8. The alloy of claim 1, wherein the $L1_2$+MC−detrimental phases at 900° C. is from 24 to 36 wt %.

9. The alloy of claim 1 wherein the mass change after 2000 h at 900° C. is from −5 to 5 mg/cm$^2$.

10. The alloy of claim 1 wherein the mass change after 2000 h at 900° C. is from −3 to 3 mg/cm$^2$.

11. The alloy of claim 1 wherein the mass change after 2000 h at 900° C. is from −2 to 2 mg/cm$^2$.

12. The alloy of claim 1, wherein the Ti+Zr atomic ratio is from 0.046 to 0.231.

13. An austenitic Ni-base alloy, consisting essentially of, in weight percent:

2.5 to 4.75 Al;
13 to 21 Cr;
20 to 40 Fe;
2.0 to 5.0 total of at least one element selected from the group consisting of Nb and Ta;
0.25 to 4.5 Ti;
0.09 to 1.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.2 C;
0.005 to 0.1 B;
0 to 0.05 P;
less than 0.06 N; and
Ni balance (38 to 47 Ni);

wherein the weight percent Ni is greater than the weight percent Fe, wherein said alloy forms an external continuous scale comprising alumina and has a stable phase FCC austenitic matrix microstructure, said austenitic matrix being essentially delta-ferrite-free, and contains one or more carbides and coherent precipitates of γ and exhibits a creep rupture lifetime of at least 200 h at 900° C. and 50 MPa.

14. An austenitic Ni-base alloy, comprising, in weight percent:

3.0 to 4.00 Al;
14 to 20 Cr;
23 to 35 Fe;
2.0 to 5.0 total of at least one element selected from the group consisting of Nb and Ta;
0.25 to 3.5 Ti;
0.09 to 0.5 Si;
0 to 0.5 V;
0 to 2 Mn;
0 to 3 Cu;
0 to 2 of at least one element selected from the group consisting of Mo and W;
0 to 1 of at least one element selected from the group consisting of Zr and Hf;
0 to 0.15 Y;
0.01 to 0.2 C;
0.005 to 0.1 B;
0 to 0.05 P;
less than 0.06 N; and
Ni balance (38 to 47 Ni);

wherein the weight percent Ni is greater than the weight percent Fe, wherein said alloy forms an external continuous scale comprising alumina and has a stable phase FCC austenitic matrix microstructure, said austenitic matrix being essentially delta-ferrite-free, and contains one or more carbides and coherent precipitates of γ' and exhibits a creep rupture lifetime of at least 500 h at 900° C. and 50 MPa.

* * * * *